US009915441B2

(12) United States Patent
Kohl et al.

(10) Patent No.: US 9,915,441 B2
(45) Date of Patent: Mar. 13, 2018

(54) HEAT EXCHANGER

(75) Inventors: Michael Kohl, Bietigheim (DE); Thomas Spranger, Stuttgart (DE); Karl-Gerd Krumbach, Burgstetten (DE); Thierry Clauss, Illkirch-Graffenstaden (FR)

(73) Assignee: MAHLE International GmbH, Stuttgart (DE)

( * ) Notice: Subject to any disclaimer, the term of this patent is extended or adjusted under 35 U.S.C. 154(b) by 789 days.

(21) Appl. No.: 13/231,556

(22) Filed: Sep. 13, 2011

(65) Prior Publication Data

US 2012/0061366 A1 Mar. 15, 2012

(30) Foreign Application Priority Data

Sep. 13, 2010 (EP) ..... 10290484

(51) Int. Cl.
*H05B 1/00* (2006.01)
*H05B 3/02* (2006.01)
(Continued)

(52) U.S. Cl.
CPC ..... *F24H 3/0429* (2013.01); *F24H 3/0435* (2013.01); *F24H 3/0447* (2013.01);
(Continued)

(58) Field of Classification Search
USPC ..... 219/202, 208; 165/41, 42, 43; 392/497–503
See application file for complete search history.

(56) References Cited

U.S. PATENT DOCUMENTS 4,327,282 A 4/1982 Nauerth
5,354,965 A * 10/1994 Lee ..... 219/202
(Continued)

FOREIGN PATENT DOCUMENTS

CN 1673642 A 9/2005
CN 101097092 A 1/2008
(Continued)

*Primary Examiner* — David Angwin
*Assistant Examiner* — Amit K Singh
(74) *Attorney, Agent, or Firm* — Muncy, Geissler, Olds & Lowe, P.C.

(57) ABSTRACT

A heat exchanger having at least one electrical resistance heating element, two conductors connected electrically to the electrical resistance heating element to conduct electric current through the electrical resistance heating element and thereby to heat the electrical resistance heating element, a heat-conducting element for transferring heat from the electrical resistance heating element to a fluid to be heated, an electrical insulating element insulating electrically the two conductors and the at least one electrical resistance heating element, and at least one tube. The two conductors, the electrical insulating element, and the electrical resistance heating element are arranged within a cavity bounded by the tube. The heat exchanger has an adapter plate and a tube opening, each being arranged at an opening of the adapter plate, and the at least one tube being connected fluid-tight to the adapter plate, which is connected fluid-tight to an electronics housing and/or an HVAC system housing.

38 Claims, 25 Drawing Sheets

(51) Int. Cl.
*F24H 3/04* (2006.01)
*F24H 9/18* (2006.01)
*H05B 3/24* (2006.01)

(52) U.S. Cl.
CPC ..... *F24H 9/1872* (2013.01); *H05B 3/24* (2013.01); *F24H 2250/04* (2013.01); *H05B 2203/023* (2013.01)

(56) References Cited

U.S. PATENT DOCUMENTS

| | | | | |
|---|---|---|---|---|
| 6,810,203 | B2 | 10/2004 | Alban et al. | |
| 7,064,301 | B2 | 6/2006 | Han et al. | |
| 7,667,166 | B2 | 2/2010 | Zeyen et al. | |
| 7,676,144 | B2 | 3/2010 | Zeyen et al. | |
| 7,881,594 | B2 * | 2/2011 | Fang et al. | 392/485 |
| 8,059,944 | B2 * | 11/2011 | Pierron et al. | 392/347 |
| 8,301,021 | B2 * | 10/2012 | Beetz et al. | 392/485 |
| 8,362,406 | B2 * | 1/2013 | Bohlender et al. | 219/548 |
| 9,234,677 | B2 | 1/2016 | Clade et al. | |
| 2005/0150885 | A1 * | 7/2005 | Angermann et al. | 219/208 |
| 2008/0000889 | A1 | 1/2008 | Niederer et al. | |
| 2008/0173637 | A1 | 7/2008 | Taguchi | |
| 2009/0020515 | A1 * | 1/2009 | Clade et al. | 219/202 |
| 2009/0107974 | A1 * | 4/2009 | Testa | 219/208 |
| 2009/0139983 | A1 | 6/2009 | Luppold et al. | |
| 2009/0314764 | A1 | 12/2009 | Mori et al. | |
| 2010/0037415 | A1 * | 2/2010 | Lansinger | 15/250.01 |

FOREIGN PATENT DOCUMENTS

| | | | |
|---|---|---|---|
| DE | 32 08 802 | A1 | 9/1983 |
| DE | 85 03 272 | U1 | 5/1985 |
| DE | 196 42 442 | A1 | 4/1998 |
| DE | 102 08 103 | A1 | 9/2003 |
| EP | 1 515 588 | A1 | 3/2005 |
| EP | 1 580 495 | A1 | 9/2005 |
| EP | 1 768 457 | A1 | 3/2007 |
| EP | 1 768 458 | A1 | 3/2007 |
| EP | 1 872 986 | A1 | 1/2008 |
| EP | 2 017 548 | A1 | 1/2009 |
| EP | 2 063 683 | A1 | 5/2009 |
| EP | 2 190 258 | A1 | 5/2010 |
| WO | WO 2007/071335 | A1 | 6/2007 |
| WO | 2008/032662 | A1 | 3/2008 |

* cited by examiner

HEAT EXCHANGER

This nonprovisional application claims priority under 35 U.S.C. § 119(a) to European Patent Application No. EP10290484.4, which was filed in Germany on Sep. 13, 2010, and which is herein incorporated by reference.

BACKGROUND OF THE INVENTION

Field of the Invention

The invention relates to a heat exchanger and to a motor vehicle HVAC system.

Description of the Background Art

Vehicle HVAC systems are used to heat and/or cool air supplied to the interior of a motor vehicle. In vehicle HVAC systems, heat exchangers are used as electrical heating devices to heat the air supplied to the interior. The electrical heating device comprises PTC elements. PTC elements (PTC: Positive Temperature Coefficient) are current-conducting materials that have an electrical resistance and can conduct current better at lower temperatures than at higher temperatures. Their electrical resistance therefore increases with increasing temperature. The PTC element generally is formed of ceramic and is a thermistor. Independent of the boundary conditions, such as, e.g., applied voltage, nominal resistance, or volume of air at the PTC element, a very uniform surface temperature arises at the PTC element. Overheating can be prevented as could occur, e.g., with a heating wire emitting normal heat, because here independent of the boundary conditions approximately the same resistance and thereby a substantially identical electrical heat output are always applied.

The heat exchanger comprises PTC elements, at least two electrical conductors by means of which electric current is conducted through the PTC element, and heat-conducting elements, particularly lamellae or corrugated fins, by means of which the surface for heating air is increased. Motor vehicles are produced increasingly, which have an exclusively electric drive or a hybrid drive. Vehicle HVAC systems for these motor vehicles generally no longer have a heat exchanger for heating air through which cooling fluid flows. The total heat output of the vehicle HVAC system for this reason must be delivered by the electrical heating device or the PTC elements. For this reason, it is also necessary to operate the PTC elements with high voltage, e.g., in the range of 50 to 600 V, instead of low voltage with 12 V. High voltage in a vehicle HVAC system is a safety problem, however, because, for example, if a person comes into contact with parts under high voltage, injuries may be inflicted on his health due to the high voltage.

U.S. Pat. No. 4,327,282 shows a heat exchanger with a PTC heating element. Current is conducted through the PTC heating element by means of contact plates and an insulating layer is arranged at the contact plates. The components are held together by a U-shaped clip.

EP 1 768 458 A1, which corresponds to U.S. Pat. No. 7,676,144, discloses a heat-producing element of a heating device for heating air, comprising at least one PTC element and electrical strip conductors that rest against opposite side surfaces of the PTC element, whereby the two electrical strip conductors are surrounded on the outside by an electrically non-conductive insulating layer.

SUMMARY OF THE INVENTION

It is therefore an object of the present invention to provide a heat exchanger and a vehicle HVAC system, in which a heat exchanger operated with electric current under high voltage, e.g., more than 50 V, can be operated without any danger to the environment, particularly to humans. The heat exchanger and the vehicle HVAC system should be inexpensive to produce and reliable to operate.

This object is attained in an embodiment, with a heat exchanger, comprising at least one electrical resistance heating element, particularly at least one PTC element, at least two conductors, particularly conductor plates, connected electrically to the at least one electrical resistance heating element, to conduct electric current through the at least one electrical resistance heating element and thereby to heat the electrical resistance heating element, at least one heat-conducting element for transferring heat from the at least one electrical resistance heating element to a fluid to be heated, at least one electrical insulating element, which insulates electrically the at least two conductors and preferably the at least one electrical resistance heating element, and at least one tube with a tube opening, whereby the at least two conductors, the at least one electrical insulating element, and the at least one electrical resistance heating element are arranged within at least one cavity, bounded by the at least one tube, whereby the heat exchanger comprises an adapter plate having at least one opening and one tube opening each is arranged at an opening of the adapter plate and preferably the at least one tube is connected fluid-tight to the adapter plate and the adapter plate is connected fluid-tight to an electronics housing and/or an HVAC system housing.

At least one electrical insulating element, at least one electrical resistance heating element, preferably a plurality of resistance heating elements, and the two conductors are arranged in the tubes, which enclose the cavity. In this case, the at least one tube has only one tube opening at the upper end, and in the other area of the tube, particularly at a lower end of the tube, the tube is closed fluid-tight, e.g., by a base plate or cover plate or due to the design of the tube. Thus, the tube has as its sole opening only the (upper) tube opening, through which fluid can penetrate into the cavity enclosed by the tube. In this case, the heat exchanger preferably has a plurality of tubes and the upper ends of the tubes with the tube openings are thereby arranged at the openings of the adapter plate, so that due to fluid-tight arrangement of the tubes at the adapter plate, fluid could reach the cavity solely through the openings of the adapter plate and the tube openings. In this regard, the adapter plate is used, for example, to connect an electronics housing fluid-tight to the adapter plate, so that thereby the cavities of the tubes are fully sealed against the surroundings, because the electronics housing is connected fluid-tight to the adapter plate. The adapter plate is thereby used as an interface for connecting with other components, particularly an electronics housing for electronics, particularly power electronics, or an HVAC housing. As a result, the components, which are arranged in the cavity enclosed by the tube, are sealed permanently fluid-tight and further the supplying of electric current to the electrical resistance heating elements is assured. For example, the electronics housing connected fluid-tight to the adapter plate has contact elements, with which the electric current can be conducted to the resistance heating elements, preferably two contact elements, and at least one or preferably two control current contact elements, with which the output of the resistance heating elements can be controlled and/or regulated with the aid of the electronics arranged in the electronics housing. In this case, these contact elements and preferably the control current contact elements are sealed fluid-tight from the electronics housing, so that the cavities are sealed fluid-tight relative to the surroundings.

In particular, a tube with an end at the tube opening can be arranged within the opening of the adapter plate.

In another embodiment, preferably at the bottom, in each case at the opening, the adapter plate has a groove, running around the opening, and one tube each is arranged with the end at the tube opening within the groove on the adapter plate.

In an embodiment, the tube can be connected fluid-tight on the outside to the adapter plate.

Preferably, the geometry of the at least one tube on the outside at the end with the tube opening corresponds to the geometry of the opening of the adapter plate.

In a variant, the tube is connected fluid-tight with the groove to the adapter plate.

The geometry of the at least one tube at the end with the tube opening expediently corresponds to the geometry of the groove.

In another embodiment, the adapter plate can be formed of at least partially, particularly totally, metal, e.g., aluminum, steel, or stainless steel, or of plastic, preferably thermoplastic, and/or there is a connection in the cavity, bounded by the at least one tube, only through the opening of the adapter plate and the tube opening with respect to the at least one tube and the adapter plate, and/or a sealing element is arranged between the adapter plate and the electronics housing and/or between the adapter plate and the HVAC housing, and in particular the sealing element is a seal, e.g., an O-ring seal, or an adhesive or silicone. The at least one tube is connected fluid-tight to the adapter plate, so that as a result with consideration of only the adapter plate and only of the tube, for example, without consideration, for example, of a sealing compound, a fluid can reach the cavity, enclosed by the tube, only through the tube opening and only the opening in the adapter plate.

The adapter plate in particular can be formed as a single piece and/or a cooling element for cooling the electronics within the electronics housing is arranged outside the electronics housing and on the electronics housing.

In another embodiment, the at least one tube is connected to the adapter plate by bonding and/or form-fittingly and/or force-fittingly.

In a supplementary variant, the at least one tube can be connected to the adapter plate with a solder, weld, or glued joint and/or the at least one tube is sealed fluid-tight against the adapter plate with a sealing element, e.g., a sealing ring, whereby the sealing element is preferably a separate part.

The adapter plate can be connected to the at least one tube with a snap-in, clip, or press connection.

In another variant, the at least one tube is made up of one or many parts, particularly two parts, in cross section, and/or the at least one tube is symmetric or asymmetric in cross section and/or the at least one tube is made up of two half-shells.

In another embodiment, the at least one electrical insulating element, preferably hardenable and/or hardened, is a sealing compound and/or the at least one electrical insulating element is a molded seal, e.g., tubing, a film, or a plate, particularly a ceramic plate, and preferably the plate is connected to the at least one electrical resistance heating element by bonding.

In a supplementary embodiment, the sealing compound is a liquid, e.g., a gel or a paste or a hardenable or a hardened liquid or an oil, particularly silicone oil, or a liquid organic compound or a solid, e.g., a powder or granules or a hardenable liquid plastic.

The sealing compound and/or the molded seal, i.e., the at least one electrical insulating element, are provided expediently with heat-transferring or heat-conducting particles, e.g., silicon carbide and/or boron nitride.

In particular, the adapter plate comprises a first connection section for connecting to an electronics housing, and/or the adapter plate comprises a second connection section for connecting to an HVAC housing, and/or the adapter plate is connected to the electronics housing and/or to the HVAC housing by bonding and/or form-fittingly and/or force-fittingly, and/or the adapter plate is connected to the electronics housing and/or to the HVAC housing with a clip connection and/or a press connection and/or a screw connection. In the first connection section of the adapter plate, therefore the adapter plate can be connected to an electronics housing and in the second connection section, the adapter plate can be connected to the HVAC housing. In this case, preferably the geometry of the first connection section is formed complementary to the geometry of the electronics housing, which in this area is to be connected to the first connection section and in a similar way the geometry of the adapter plate at the second connection section is complementary to the section of the HVAC housing, which is to be connected to the second connection section of the adapter plate. The adapter plate is expediently connected to the electronics housing and/or to the HVAC housing with a separable connection, e.g., a screw or clip connection, or with an inseparable connection, e.g., a press connection, or a solder or weld connection.

In another variant, a sealing element, e.g., a seal, particularly an O-ring seal, or adhesive or silicone as a sealing element is arranged in the first connection section and/or the second connection section for fluid-tight sealing between the adapter plate and the electronics housing and/or between the adapter plate and the HVAC housing.

In an additional embodiment, the electronics housing and/or the HVAC housing is formed at least partially, particularly totally, of metal, e.g., aluminum or steel, or of plastic, preferably thermoplastic.

The sealing element can be elastically pretensioned and/or overcompressed between the adapter plate and the electronics housing and/or the HVAC housing, to assure a reliable seal.

In an embodiment, the at least one cavity wall as the wall of the at least one tube in a cross section comprises two broad side walls and one or two narrow side walls and/or the at least one cavity wall forms a closed tube, particularly a flat tube, in a cross section.

In another embodiment, the at least one heat-conducting element comprises the at least one cavity wall and/or the at least one heat-conducting element comprises corrugated fins, which are arranged on the outside on the at least one cavity wall, particularly by soldering, and/or the at least two conductors are not in direct contact with the at least one cavity wall.

In another embodiment, the corrugated fins and the at least one cavity wall are joined together by means of gluing.

In an embodiment, at least one heat-conducting element, particularly the at least one cavity wall, and/or the corrugated fins is formed at least partially, particularly totally, of metal, for example, aluminum or steel, or plastic.

The at least one molded seal can be elastic and/or the at least one molded seal can be formed at least partially of silicone or plastic or rubber and/or the at least one molded seal is connected to the at least one cavity wall force-fittingly and/or form-fittingly and/or by bonding. Based on the elastic properties of the at least one molded seal, by means of elastic deformation of the at least one molded seal, the at least one molded seal can be fixed within the cavity, i.e., between the cavity walls, and thereby connected force-fittingly.

In another embodiment, the at least one molded seal forms heat-transferring or heat-conducting particles, e.g., aluminum oxide and/or silicon carbide and/or boron nitride. As a result, the thermal conductivity of the at least one molded seal can be increased and nonetheless the at least one molded seal has a sufficiently high electrical insulation.

In particular, at least one electrical resistance heating element, the at least two conductors, and the at least one electrical insulating element are connected together to form at least one heating subassembly, which is or are arranged in the at least one cavity.

A vehicle HVAC system of the invention comprises at least one heat exchanger described in this property rights application.

The at least one molded seal can be arranged between a wall of the at least one tube and a conductor, so that the at least two conductors are electrically insulated relative to the at least one tube.

The at least one tube can be closed fluid-tight by a bottom cover plate at a lower second end. The lower second end is the other end of the tube, which lies opposite to the upper first end with the tube opening.

In another embodiment, the at least one molded seal can be formed as heat shrink tubing and the heat shrink tubing is shrunk onto the at least two conductors by heating the heat shrink tubing.

The at least one molded seal has an electrically insulating and thermally conductive material. Due to the geometric arrangement of the at least one molded seal within the heat exchanger, the at least two conductors and the at least one electrical resistance heating element are electrically insulated. The molded seal is in a solid state, i.e., not liquid or gaseous, also at high temperatures, e.g., 70° C. or 100° C.

In another embodiment, the at least one molded seal can be a film or insulation film, e.g., a polyimide film (Kapton film), (elastic) ceramic-filled film, or an (elastic) ceramic-filled silicone film.

In an embodiment, the heat exchanger has an IP code of 67, so that a sufficient water tightness and dust tightness are present.

In another embodiment, the corrugated fins and the at least one tube are joined together by gluing and/or soldering and/or force-fittingly under pretensioning.

In another embodiment, the at least one heat-conducting element and/or the at least one electrical insulating element have a thermal conductivity of at least 1 W/mK, particularly at least 15 W/mK.

In another embodiment, the at least one electrical insulating element has an electrical insulation of at least 1 kV/mm, particularly at least 25 kV/mm.

In an embodiment, the at least one electrical insulating element, preferably in cross section, has a dielectric strength of at least 1 kV.

In another embodiment, the at least one electrical insulating element has a thermal conductivity of at least 1 W/mK, particularly at least 15 W/mK. The at least one electrical insulating element, on the one hand, can thereby produce good electrical insulation and, on the other, conduct heat sufficiently well from the electrical resistance heating element to the heat-conducting element or the heat-conducting elements.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
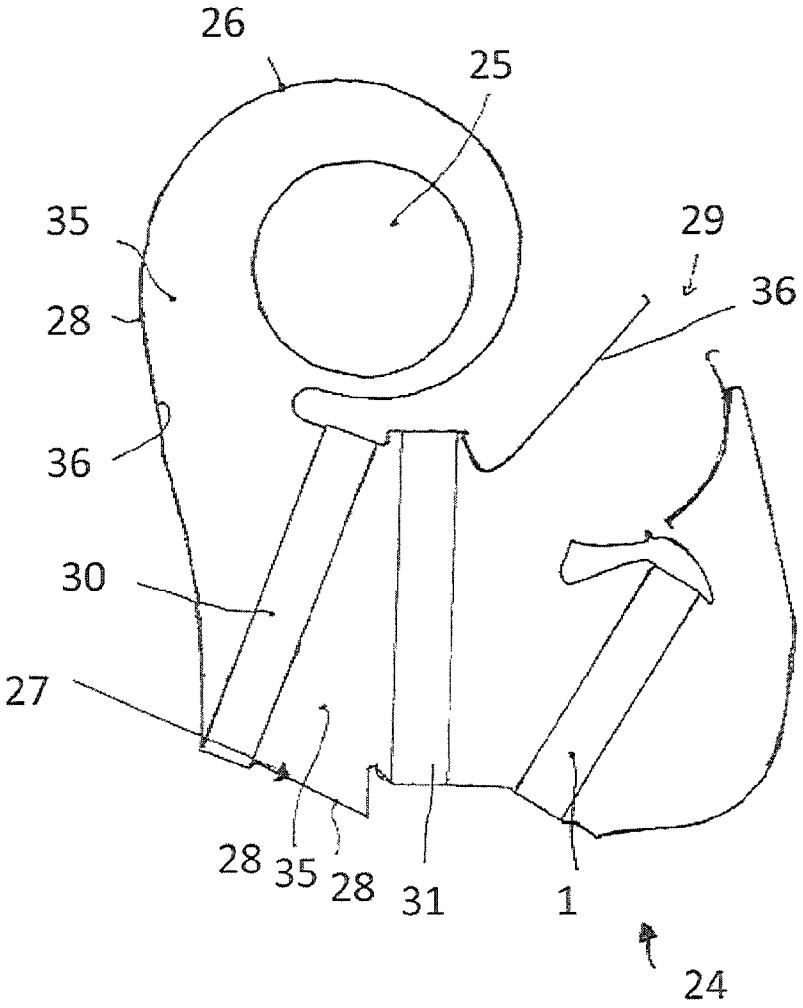
FIG. 1 shows a cross section of a vehicle HVAC system.

FIG. 1 shows a vehicle HVAC system 24. A fan 25, an air filter 30, a coolant evaporator 31, and a heat exchanger 1 as an electrical heating device are arranged in an HVAC housing 26 having a bottom wall 27 and an exit section 29. HVAC housing 26 thus forms a channel 35 for the passing of air. Walls 28 of HVAC housing 26 have on the inner side a surface 36, which forms the bounds of channel 35. The air for the interior of a motor vehicle is conveyed by fan 25 through air filter 30, coolant evaporator 31, and heat exchanger 1.

The air conveyed through vehicle HVAC system 24 is heated electrically solely by heat exchanger 1. Vehicle HVAC system 24 is preferably used in a motor vehicle with an exclusively electrical drive or with a hybrid drive (not shown). To achieve the necessary electrical heat output by means of heat exchanger 1, the heat exchanger must be operated with a high voltage, e.g., with more than 50 V, for example, with 60 V or 600 V, in order not to receive too high current strengths and thereby to use too thick power supply lines (not shown).

Figure 2:
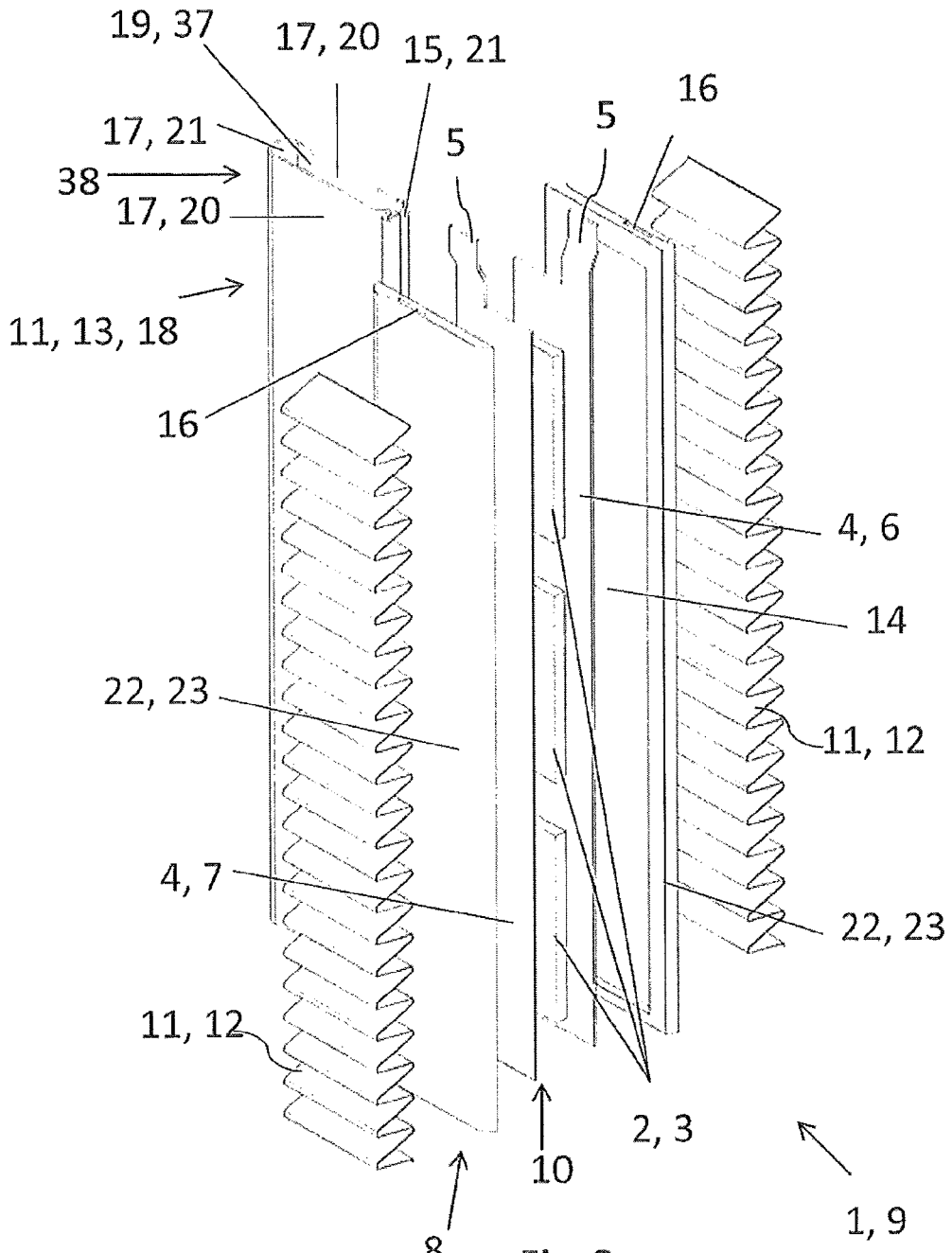
FIG. 2 shows an exploded view of a heat exchanger or heating register in a first exemplary embodiment.
Figure 4:
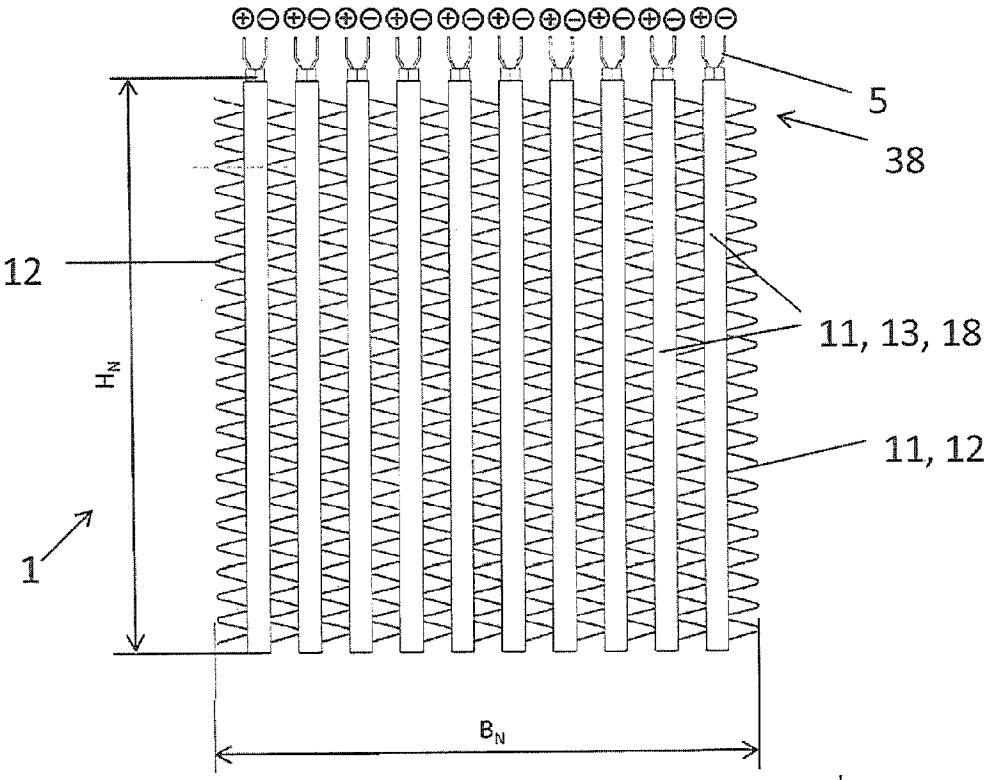
FIG. 4 shows a side view of the heat exchanger according to FIG. 3.
Figure 5:
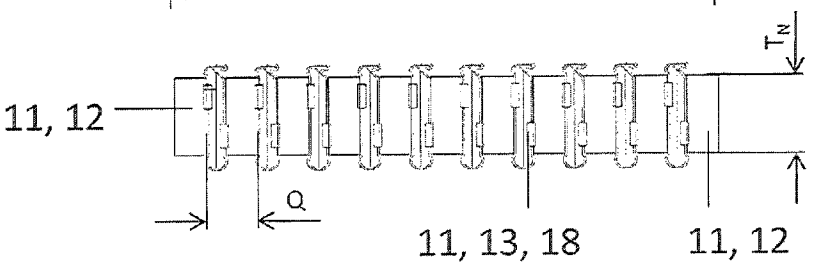
FIG. 5 shows a plan view of the heat exchanger according to FIG. 3.
Figure 6:
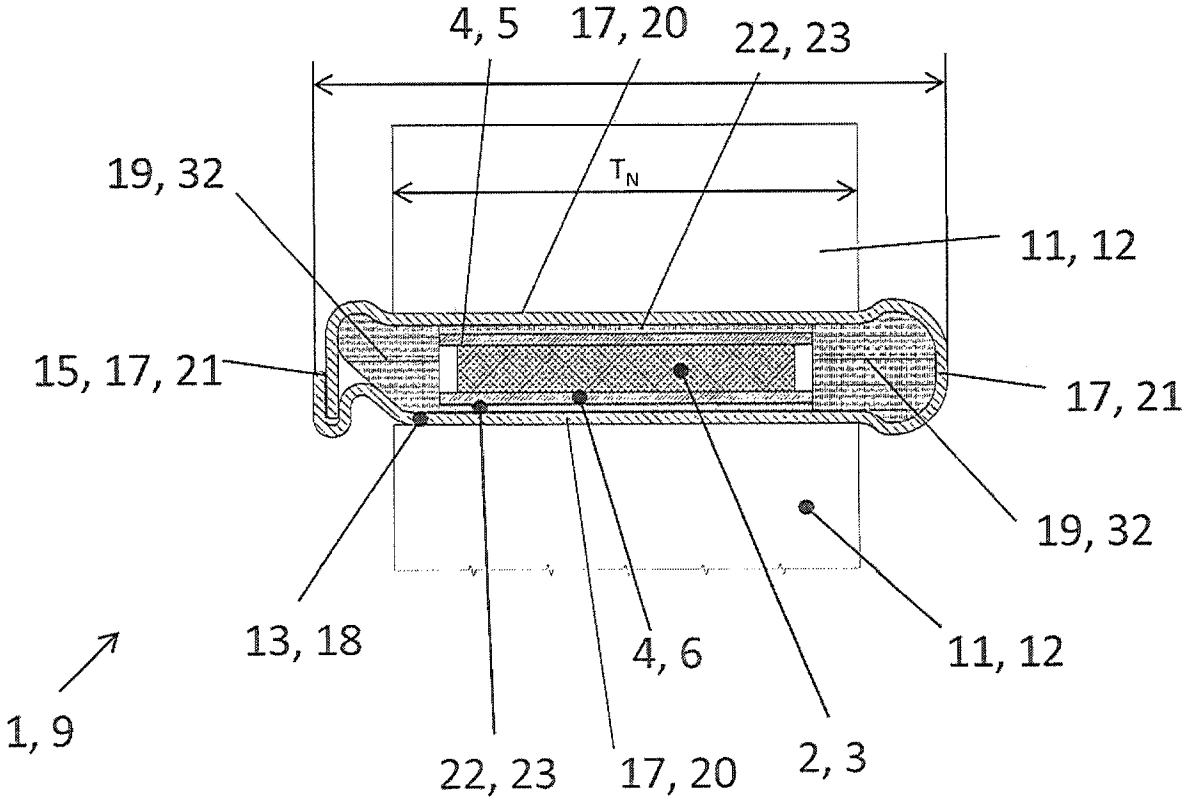
FIG. 6 shows a cross section of the heating register according to FIG. 2.

A first exemplary embodiment of heat exchanger 1 for vehicle HVAC system 24 without an adapter plate 34 is shown in FIGS. 2 to 9. Heat exchanger 1 in the first exemplary embodiment, however, comprises adapter plate 34 which is not shown. Tube 18, formed as a flat tube 13 from aluminum, has two broad side walls 20 and two narrow side walls 21 (FIGS. 2 and 6). Broad and narrow side walls 20, 21 in this case represent cavity walls 17, which enclose a cavity 19 within tube 18. A narrow side wall 21 in this case is joined together by a tongue and groove joint 15. The two molded seals 23 as electrical insulating elements 22 are arranged within flat tube 13. The two molded seals 23 are formed of elastic silicone and each have a recessed area 14 on one side. Two conductors 4, namely, a first conductor plate 6 and a second conductor plate 7 are arranged within these two recessed areas 14 of the two molded seals 23, which when the two molded seals 23 lie one on top of another thereby form a receiving cavity. Three electrical resistance heating elements 2 formed as PTC elements 3 are arranged between the two conductor plates 6, 7. PTC elements 3 in this case are joined to the two conductor plates 6, 7 with an adhesive. The two molded seals 23 in this case each have a slot 16 (FIG. 2), through which an electrical contact plate 5 of the conductor plate 6, 7 is guided. Tube 18 has an upper end 38 with a tube opening 37. Tube 18 is closed fluid-tight at the lower end.

Figure 3:
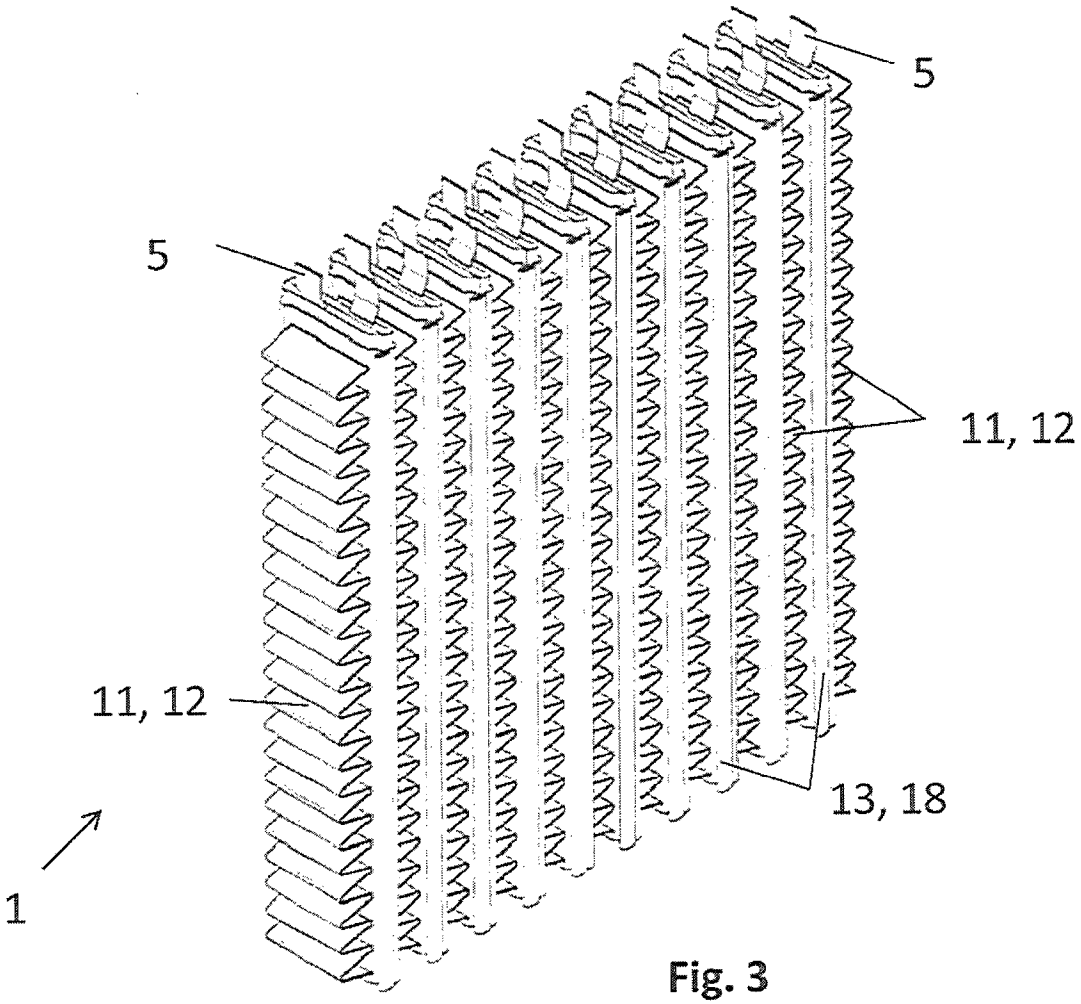
FIG. 3 shows a perspective view of a plurality of heat exchangers according to FIG. 2.

The two conductor plates 6, 7 are thereby completely enclosed by the two molded seals 23, because molded seals 23 lie directly on one another at the edges outside recessed area 14 and thereby also seal due to their elastic properties. As a result, the two conductor plates 6, 7 with the three PTC elements 3, arranged between them, due to the electrical insulation of molded seals 23 are electrically insulated and in addition fluid-tight due to the sealing properties of molded seals 23, lying one on top of another. The electrical contacting of the two conductor plates 6, 7 occurs by means of electrical lines (not shown) at contact plates 5. The two conductor plates 6, 7 with the three PTC elements 10 thereby represent a heating unit 10. After the enclosing of heating unit 10 with the two molded seals 23, these form a heating subassembly 8. A heating register 9 or the heat exchanger 1 is created once heating subassembly 8 is inserted in flat tube 13 with corrugated fins 12. A plurality of heating registers 9 according to the illustration in FIG. 4 can also be connected to one another to form a heat exchanger 1 with a larger number of heating registers 9 (FIGS. 3 to 5).

Figure 9:
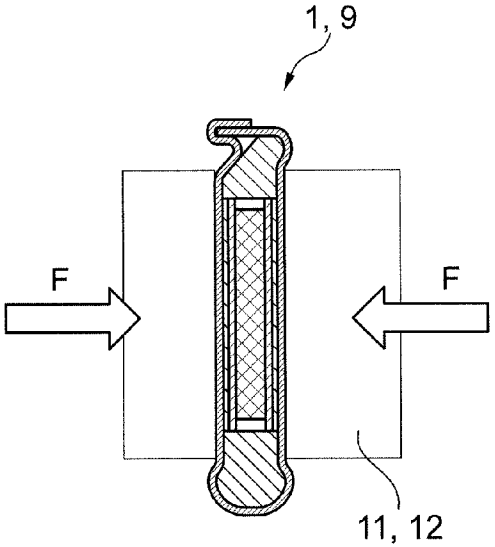
FIG. 9 shows a cross section of the flat tube with the heating subassembly in the flat tube as a heating register or heat exchanger.
Figure 8:
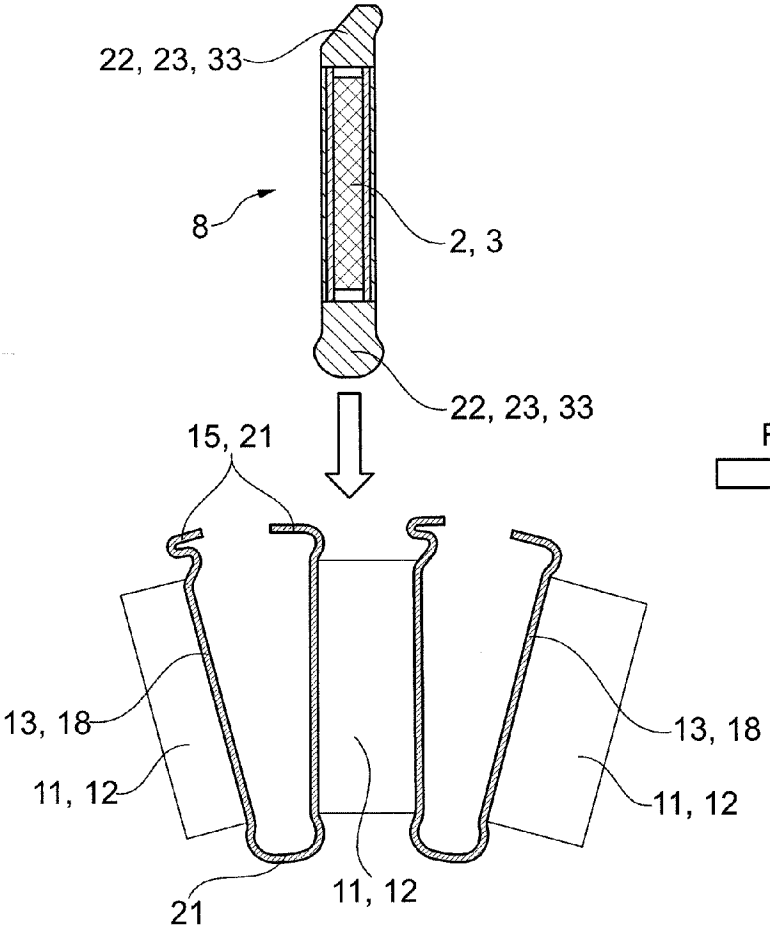
FIG. 8 shows a cross section of three flat tubes and a heating subassembly.
Figure 7:
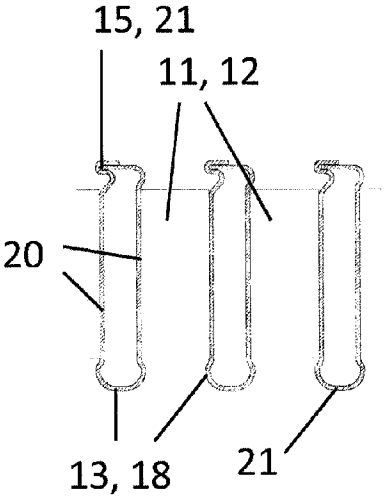
FIG. 7 shows a cross section of a plurality of flat tubes.

The fabrication steps for arranging heating subassembly 8 in flat tubes 13 are shown in FIGS. 7 to 9. Flat tubes 13 are joined together with corrugated fins 12 by soldering in a soldering furnace. In the area of tongue-and-groove joint 15, a spacer (not shown) is inserted in tongue-and-groove joint 15 during soldering, so that flat tubes 13 are not soldered together at tongue-and-groove joint 15, i.e., not joined together by bonding. After the removal of the spacer (not shown), flat tubes 13 are opened in the area of tongue-and-groove joint 15, so that flat tubes 13 deform, particularly bend, in the area of the bottom narrow side walls 21. The opening of flat tubes 13 with corrugated fins 12 in this case occurs in an accordion-like manner according to the illustration in FIG. 7 to FIG. 8. In the open position of flat tube 13 as shown in FIG. 8, heating subassemblies 8 can be pushed into flat tubes 13 in the direction of the depth of the tube, i.e., perpendicular to the longitudinal axis of tube 18, said axis which is perpendicular to the plane of the drawing in FIG. 8. After the insertion of heating subassembly 8 into flat tubes 13, flat tubes 13 are again joined together at tongue-and-groove joint 15 and a permanent fixation of tongue-and-groove joint 15 is made by the pressing of tongue-and-groove joint 15. Molded seals 23 are made of silicone and elastically deformable; in this case, the size of molded seals 23 is matched to heating unit 10 to the effect that heating subassembly 8 is slightly larger than the closed flat tube 13. As a result, molded seals 23 during closing of tongue-and-groove joints 15 are elastically deformed and pretensioned, so that thereby heating subassembly 8 under pretensioning is fixed between cavity walls 17 of flat tube 13, particularly between broad side walls 20 of flat tube 13 and thereby connected force-fittingly to flat tube 13. To this end, a correspondingly directed force F is applied to broad side walls 20 (FIG. 9).

The grid height $H_N$ of heat exchanger 1 according to the illustration in FIG. 4 is about 50 to 300 mm, preferably 100 to 200 mm, and the grid width $B_N$ is about 50 to 300 mm, preferably 100 to 200 mm. The transverse pitch Q, i.e., the distance between flat tubes 13 according to the illustration in FIG. 5, in this case is between 5 and 30 mm, preferably 9 to 18 mm, and the grid depth $T_N$ according to the illustration in FIG. 5 is 6 to 60 mm, preferably 10 to 40 mm.

Cavity 19 enclosed by cavity walls 17 of flat tube 13 in the area of narrow side walls 21 is a void space 32; i.e., there is only air in void space 32 (FIG. 6). As a departure from this, according to the illustration in FIG. 6, molded seal 23 can also be arranged in void spaces 32 in the case of a suitably different geometric design of molded seal 23 (FIG. 8). At the upper end 38 of tubes 18, tubes 18 are arranged in openings 39 of adapter plate 34 (which is not shown) analogous to the following exemplary embodiments.

Figure 10:
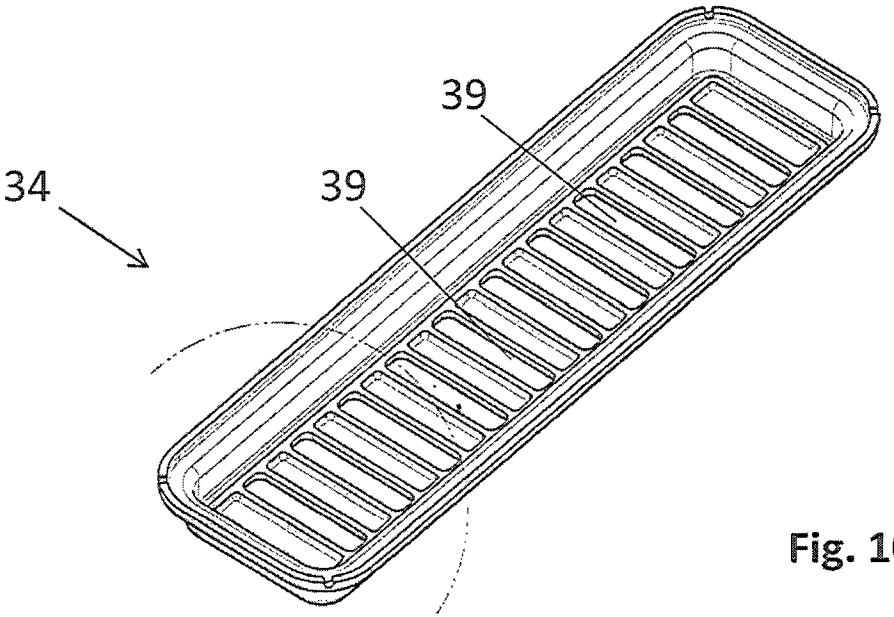
FIG. 10 shows a perspective view of an adapter plate in a first exemplary embodiment.
Figure 11:
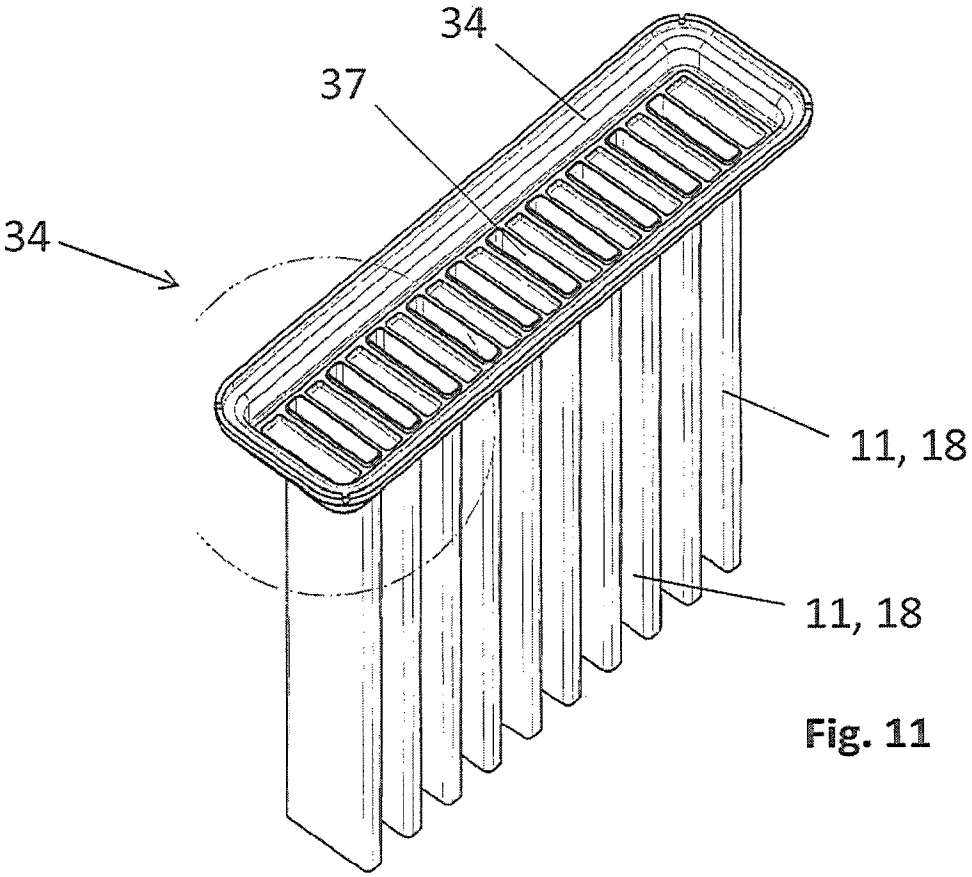
FIG. 11 shows a perspective view of the adapter plate according to FIG. 10 with tubes in the openings of the adapter plate.

A first exemplary embodiment of adapter plate 34 with openings 39 is shown in FIGS. 10 and 11. Adapter plate 34 includes thermoplastic or of metal, particularly aluminum, and in one design is made of aluminum by deep drawing. In this case, the geometry of openings 39 of adapter plate 34 corresponds to the geometry of tubes 18 at the upper end 38 (FIG. 2) of tubes 18. Here, tubes 18 are inserted with end 38 into openings 39 of adapter plate 34 (FIG. 11) and joined by bonding to adapter plate 34, for example, by soldering or gluing. In FIG. 11, only tubes 18 of heating register 9 are shown, but not conductors 4, electrical contact plates 5, and electrical insulating element 22. Heating subassembly 8 is therefore not shown in FIG. 11. As a result, in cavity 19 enclosed by tube 18, due to the fluid-tight connection of tubes 18 to adapter plate 34, there is a fluid-conducting connection in cavity 19 only through opening 39 of adapter plate 34 and tube openings 37. Tube 18 shown in FIG. 11 is a single piece in cross section and has two narrow side walls 21 and two broad side walls 20.

Figure 13:
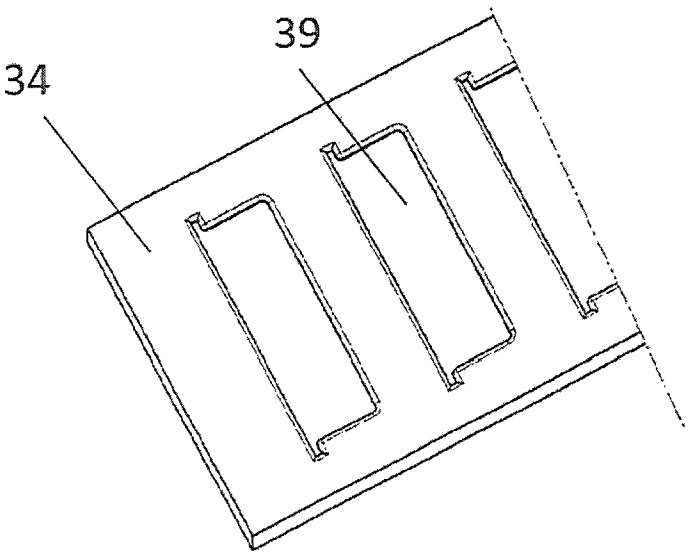
FIG. 13 shows a perspective view of the adapter plate according to FIG. 12.
Figure 12:
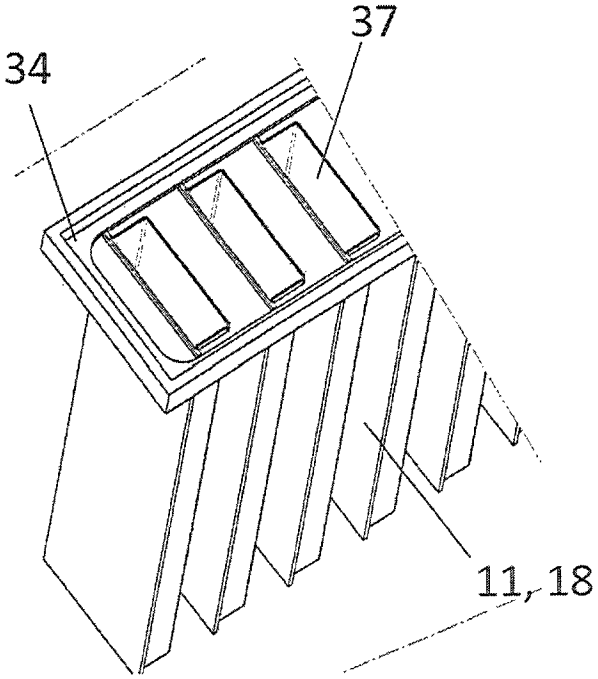
FIG. 12 shows a perspective view of the adapter plate in a second exemplary embodiment with tubes in the openings of the adapter plate.
Figure 14:
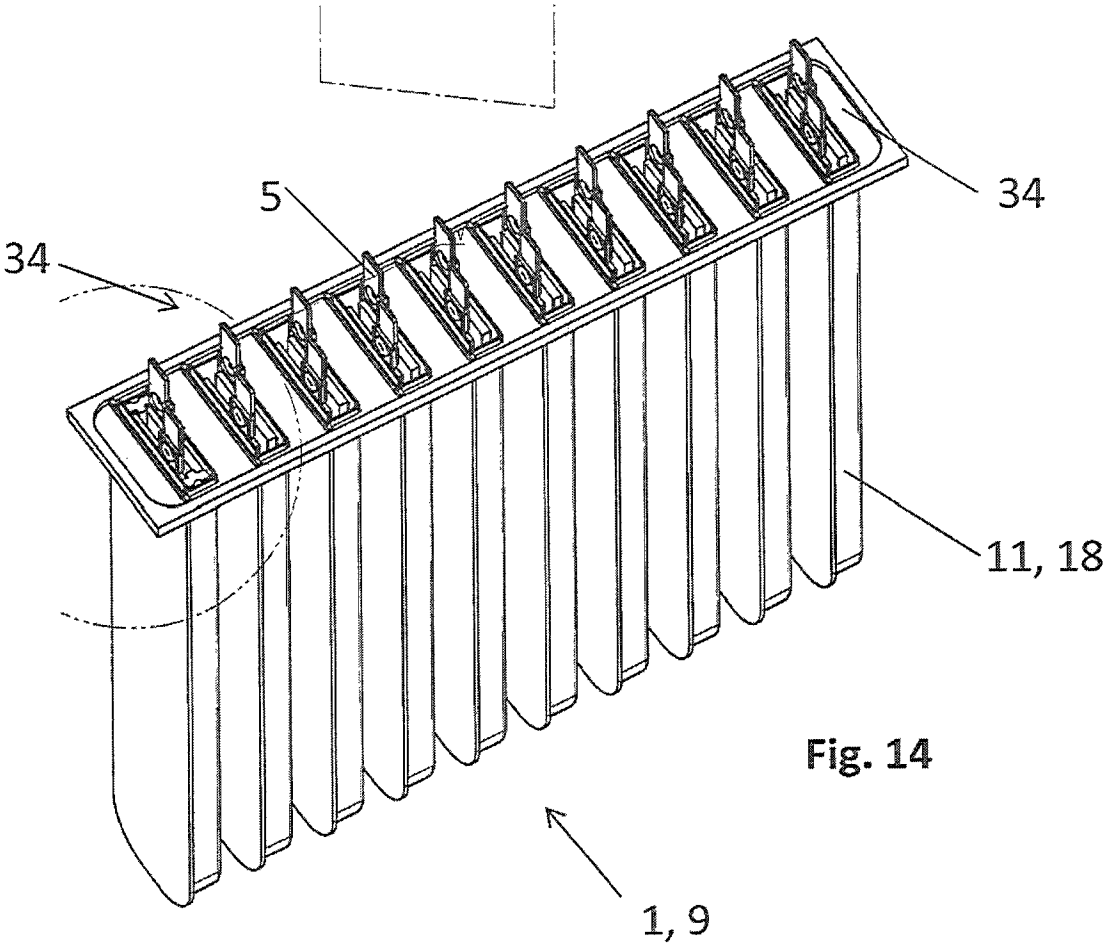
FIG. 14 shows a perspective view of the adapter plate according to FIG. 12 with heating registers.

A second exemplary embodiment of adapter plate 34 is shown in FIGS. 12, 13, and 14. The geometry of openings 39 of adapter plate 34 thereby corresponds to the external geometry of tube 18 according to FIGS. 12 and 14. In this regard, tube 18 in cross section has two parts comprising two asymmetric half-shells 18*a* and 18*b* (see FIG. 18). The geometry of openings 39 of adapter plate 34 is also formed accordingly. Adapter plate 34 according to FIGS. 12 and 13 with heating registers 9 is shown in FIG. 14.

Figure 15:
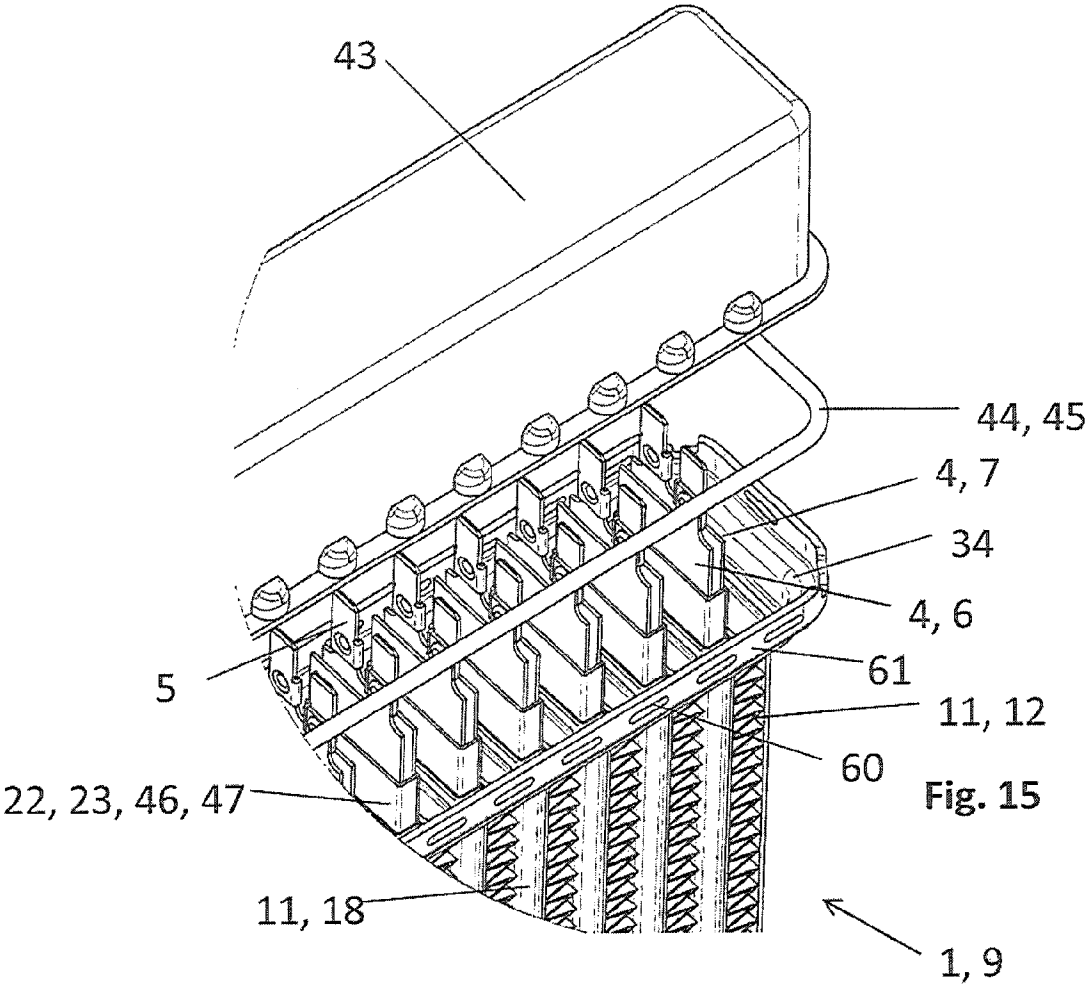
FIG. 15 shows a perspective partial view of the adapter plate in a third exemplary embodiment with heating registers and an electronics housing with a press connection for connecting the adapter plate to the electronics housing.

Adapter plate 34 is used as an interface for connection to other components, for example, to an electronics housing 43 with electronics (not shown), particularly power electronics for the control and/or regulation of the output of electrical resistance heating elements 2 in individual heating registers 9. An exploded illustration of electronics housing 43 and heat exchanger 1 with adapter plate 34 in a third exemplary embodiment is shown in the partial view in FIG. 15. Individual heating registers 9 are joined together by means of adapter plate 34 and a fluid-tight connection between electronics housing 43 and adapter plate 34 can be made by means of a seal 45 as sealing element 44, for example, an elastic O-ring seal made of rubber, and further electronics housing 43 is connected mechanically by a press connection 53 to adapter plate 34. In this case, electronics housing 43 is completely closed and has no openings or gaps into the surroundings, so that with a fluid-tight connection of electronics housing 43 to adapter plate 34 due to the fluid-tight connection of tubes 18 to adapter plate 34, cavity 19 is sealed fluid-tight relative to the surroundings. Further, electrical contact plates 5 and molded seal 23 formed as tubing 46 or film 47 are shown in FIG. 15. In this case, tubing 46, which completely surrounds heating unit 10, is extended slightly beyond the upper end 38 of tubes 18, so that there is a sufficient distance from the two conductor plates 6, 7 to tube 18. In this case, this distance is preferably 4 mm. Further, corrugated fins 12 as heat conducting elements 11 between tubes 18 are shown in FIG. 15 in contrast to the preceding FIGS. 10 to 14.

Figure 16:
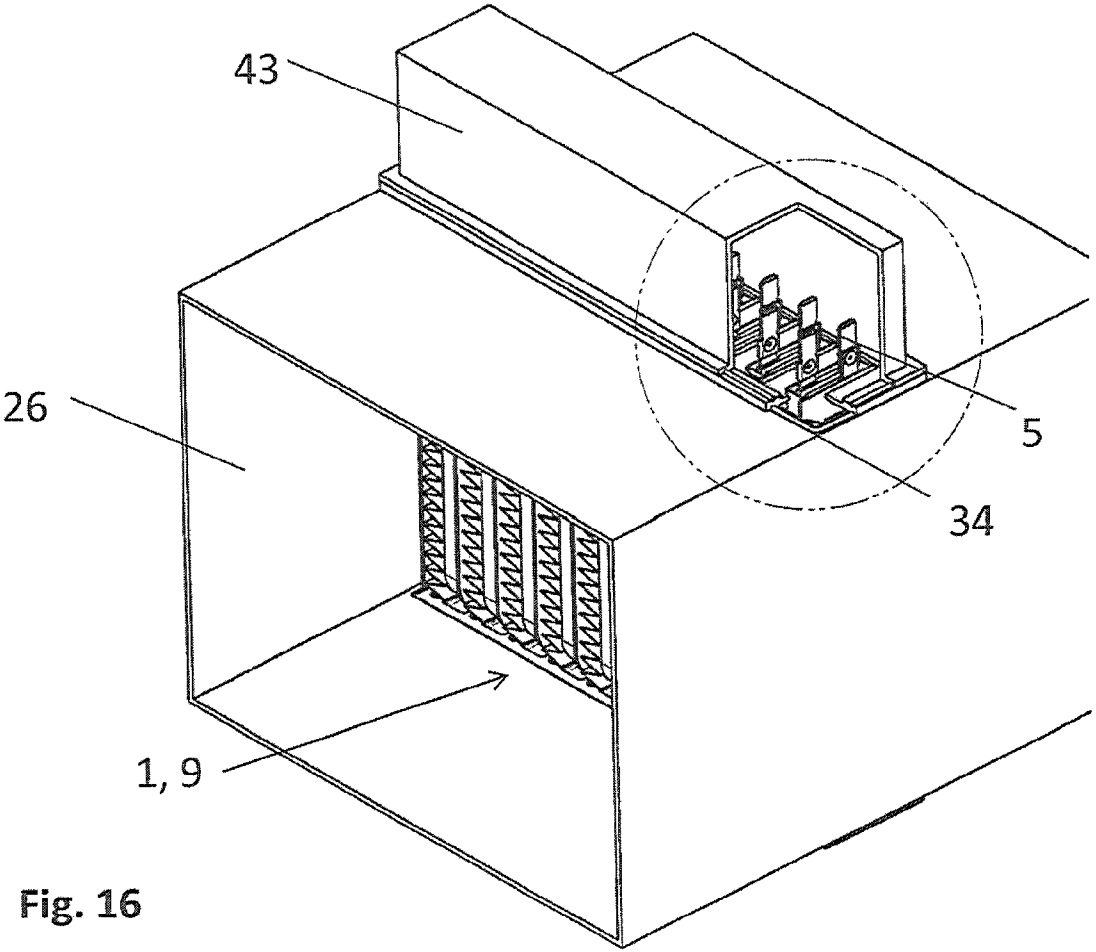
FIG. 16 shows a perspective view of a heat exchanger with the adapter plate, the electronics housing, and an HVAC housing.
Figure 17:
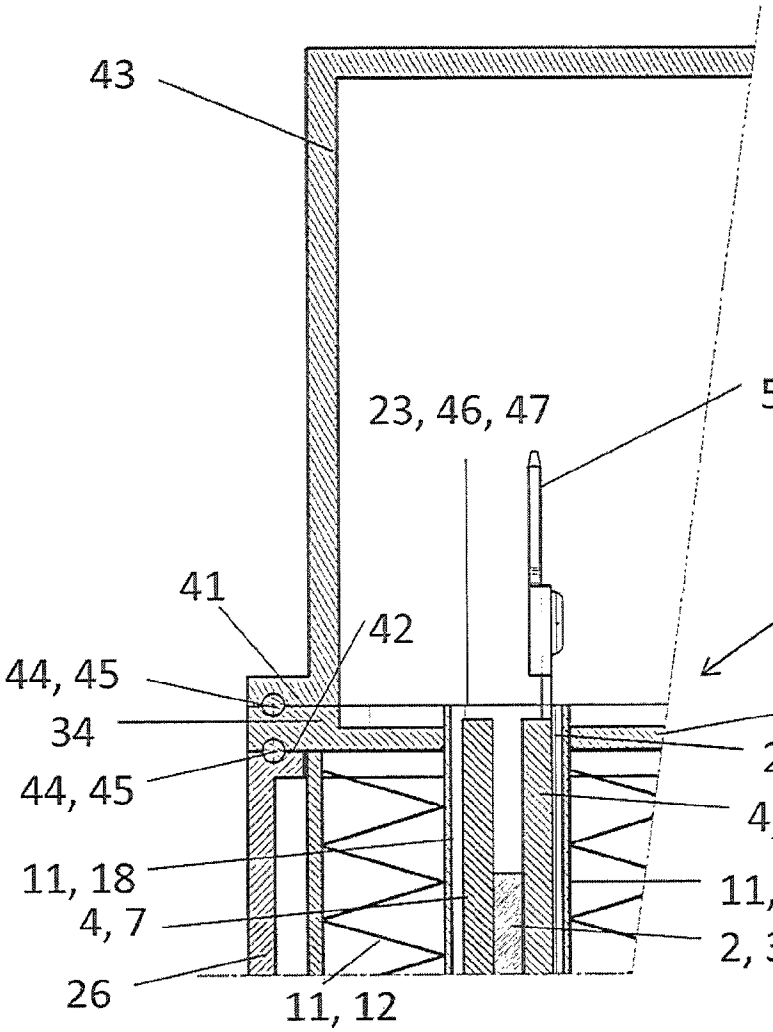
FIG. 17 shows a longitudinal section of the heat exchanger according to FIG. 16.

A perspective view of heat exchanger 1 in HVAC housing 26 is shown in FIG. 16. In this case, adapter plate 34 is connected fluid-tight to electronics housing 43 and fluid-tight to HVAC housing 26. The type of design of the fluid-tight connection between adapter plate 34 and electronics housing 43 and the fluid-tight connection between adapter plate 34 and HVAC housing 26 is identical. It is possible as a result to seal cavity 19, enclosed by tubes 18, fluid-tight relative to the surroundings and during use of high voltage in electrical resistance heating elements 2 to assure a safe electrical insulation relative to the environment. FIG. 17 shows a longitudinal section of heat exchanger 1 according to FIG. 16. Adapter plate 34 has a first connection section 41 for connecting adapter plate 34 to electronics housing 43 and a second connection section 42 for connecting adapter plate 34 to HVAC housing 26. In this case, HVAC housing 26 and/or electronics housing 43 are connected form-fittingly and/or force-fittingly or by bonding to adapter plate 34, for example, with a glued or solder joint or also with the use of a screw or snap-in connection (not shown). A sealing element 44, particularly a seal 45, is arranged in each case both between adapter plate 34 and electronics housing 43 in first connection section 41 and between adapter plate 34 and HVAC housing 26 in second connection section 42. In so doing, seal 45 is formed preferably as an O-ring seal, which runs completely around first and/or second connection section 41, 42, so that a fluid-tight connection is assured thereby both in the first and in the second connection section 41, 42 relative to HVAC housing 26 and electronics housing 43. Sealing element 44 here can be either a separate part or be already built or integrated into electronics housing 43 and/or HVAC housing 46, in that, for example, sealing element 44 during injection molding of electronics housing 43 of plastic or HVAC housing 26 is placed and molded in the injection molding tool or sealing element 44 is produced in a 2K injection molding process on the rest of HVAC housing 26 and/or the rest of electronics housing 43. Tubes 18 are connected fluid-tight with adapter plate 34, for example, with a glued joint and arranged in openings 39 of adapter plate 34.

Figure 18:
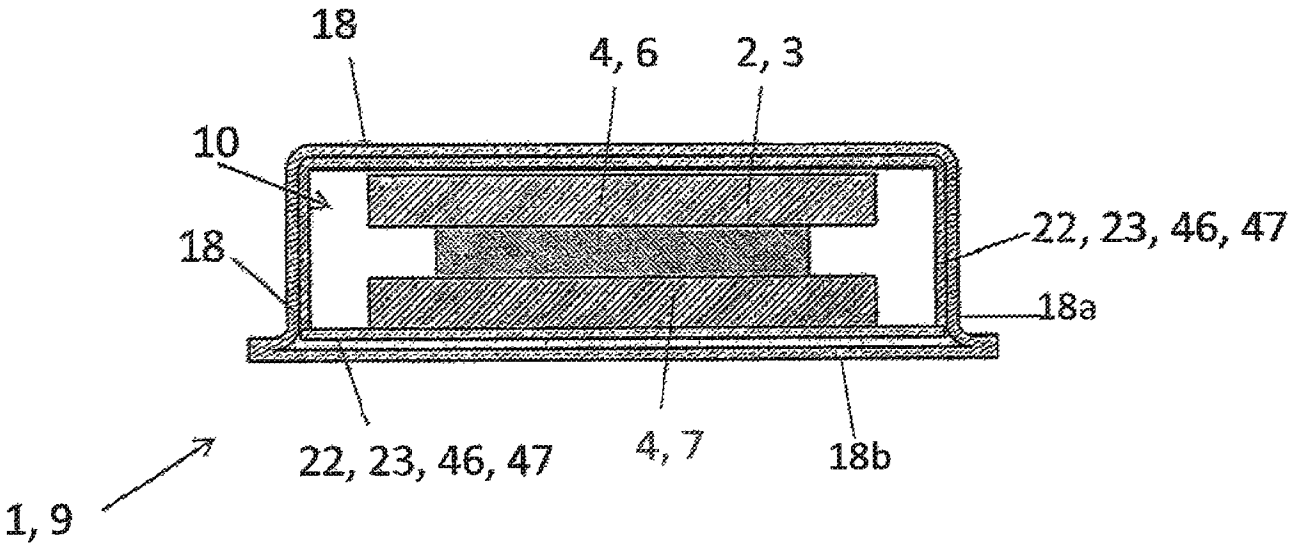
FIG. 18 shows a cross section of the heating register in a second exemplary embodiment.

FIG. 18 shows a cross section of heating register 9 in a second exemplary embodiment. Heating unit 10 is surrounded by tubing 46 or a film bag and, in this case, the wall of the tubing is formed as film 47. As a result, heating unit 10 is completely surrounded (the film bag or tubing 46 has an opening only at the top at contact plates 5) by the tubing 46 or film bag and thereby insulated electrically relative to tube 18 or the walls of tube 18. Seal 45 or molded seal 23 here can also be provided with electrically conductive particles, to assure a sufficient thermal conductivity of molded seal 23 as well, apart from the necessary electrical insulation.

Figure 19:
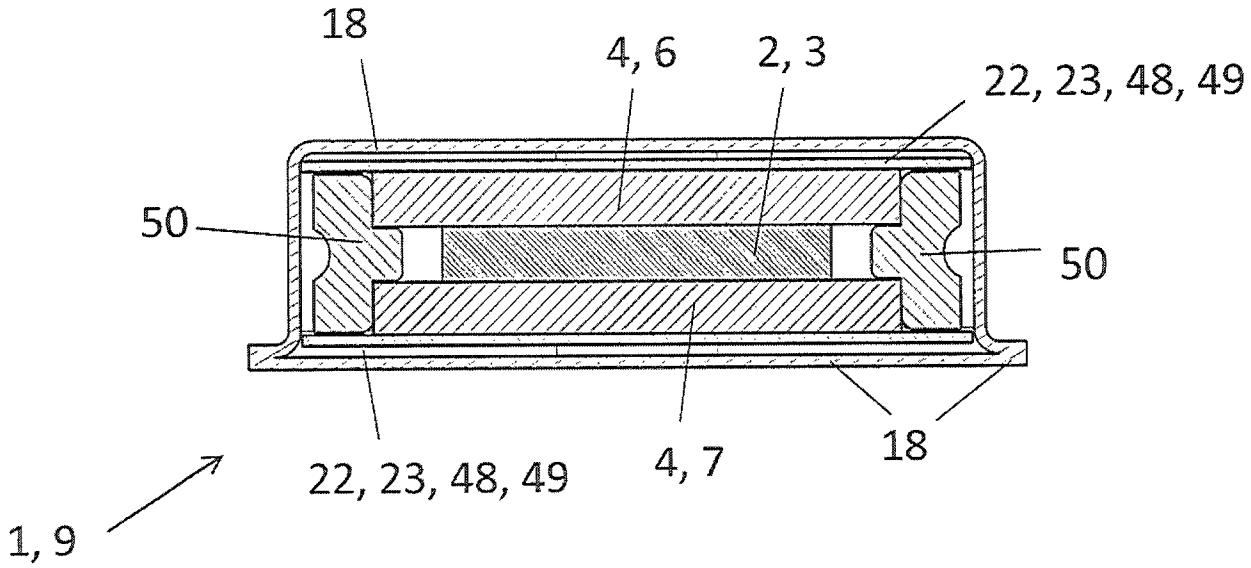
FIG. 19 shows a cross section of the heating register in a third exemplary embodiment.

A third exemplary embodiment of heating register 9 is shown in FIG. 19. Substantially only the differences with respect to the second exemplary embodiment according to FIG. 18 will be described below. Molded seal 23 is a plate 48, formed as ceramic plate 49, and a positioning strip 50 is also present within tube 18. Positioning strip 50 prevents slipping of heating unit 10 within tube 18, so that a sufficient electrical insulation is assured. As a departure (not shown), positioning strip 50 can also be omitted, provided ceramic plates 49 are connected by bonding, for example, by gluing, to both conductors 24, and thereby due to the sufficient stiffness of ceramic plates 49 there no longer is a risk of the slipping of heating unit 10 within tube 18.

Figure 20:
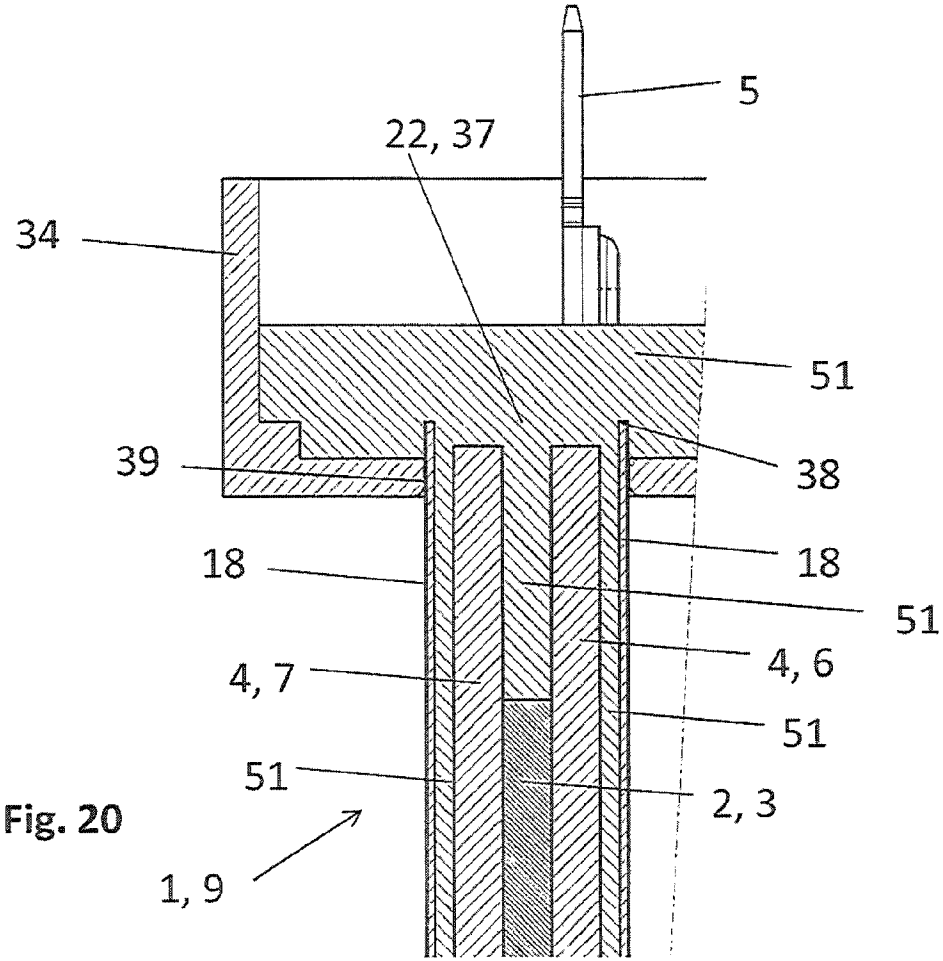
FIG. 20 shows a longitudinal section of the heating register in a fourth exemplary embodiment.

FIG. 20 shows a fourth exemplary embodiment of heating register 9 in a longitudinal section. In this case, a sealing compound 51 is used as the electrical insulating element 22. After insertion of heating unit 10 into cavity 19 and the mechanical and fluid-tight connection of tubes 18 to adapter plate 34, sealing compound 51 is applied at the top to adapter plate 34. The flowable or liquid sealing compound 51 can thus flow into cavities 19 within tubes 18 and fill the empty cavities 19 outside heating unit 10 and thereby make possible an electrical insulation. In so doing, adapter plate 34 due to its geometry serves as a "spillover area" for sealing compound 51, and only electrical contact plates 5 and if applicable a rather small part of conductor plates 4 project from sealing compound 51. After hardening of sealing compound 51, thus a permanent electrical insulation of heating unit 10 is available and, further, cavity 19 is sealed fluid-tight relative to the surroundings with sealing compound 51, because no liquid or a fluid can flow into cavity 19. Only electrical contact plates 5 and if applicable conductors 4 outside sealing compound 51 are to be insulated electrically permanently from the surroundings, for example, in that electronics housing 43 is placed on adapter plate 34 and will be or is connected fluid-tight to adapter plate 34 (not shown).

Figure 21:
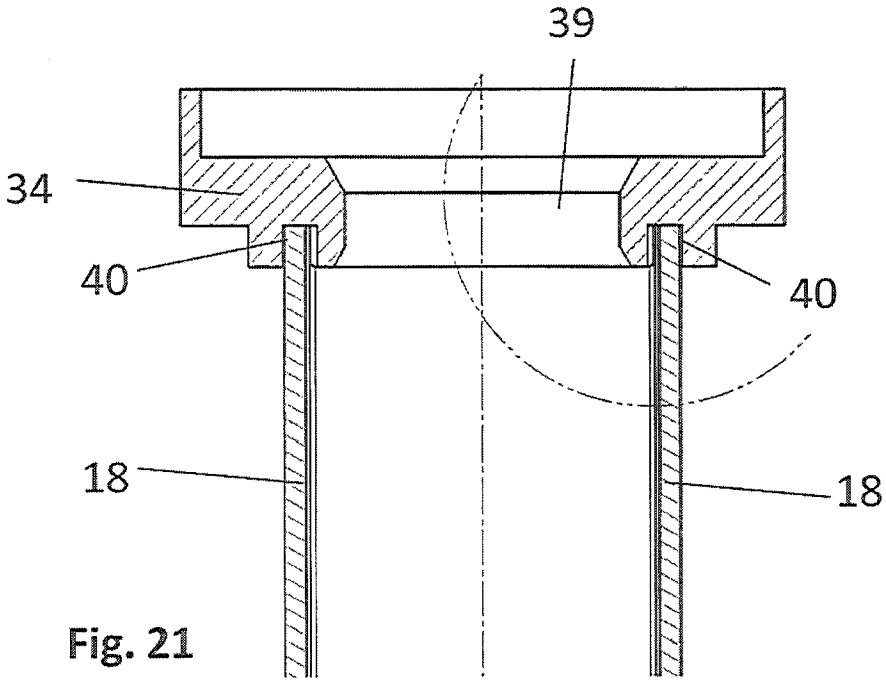
FIG. 21 shows a longitudinal section of the tubes with the adapter plate in a fourth exemplary embodiment.

A fourth exemplary embodiment of adapter plate 34 is shown in FIG. 21. Tubes 18 of heating register 9 in this case are not inserted in openings 39 of adapter plate 34, but adapter plate 34 is provided with a groove 40 running completely around openings 39 and ends 38 of tubes 18 are arranged in groove 40 and connected mechanically to adapter plate 34 at groove 40 and also connected fluid-tight. The connection can be made by bonding, for example, by gluing, welding, or soldering.

Figure 22:
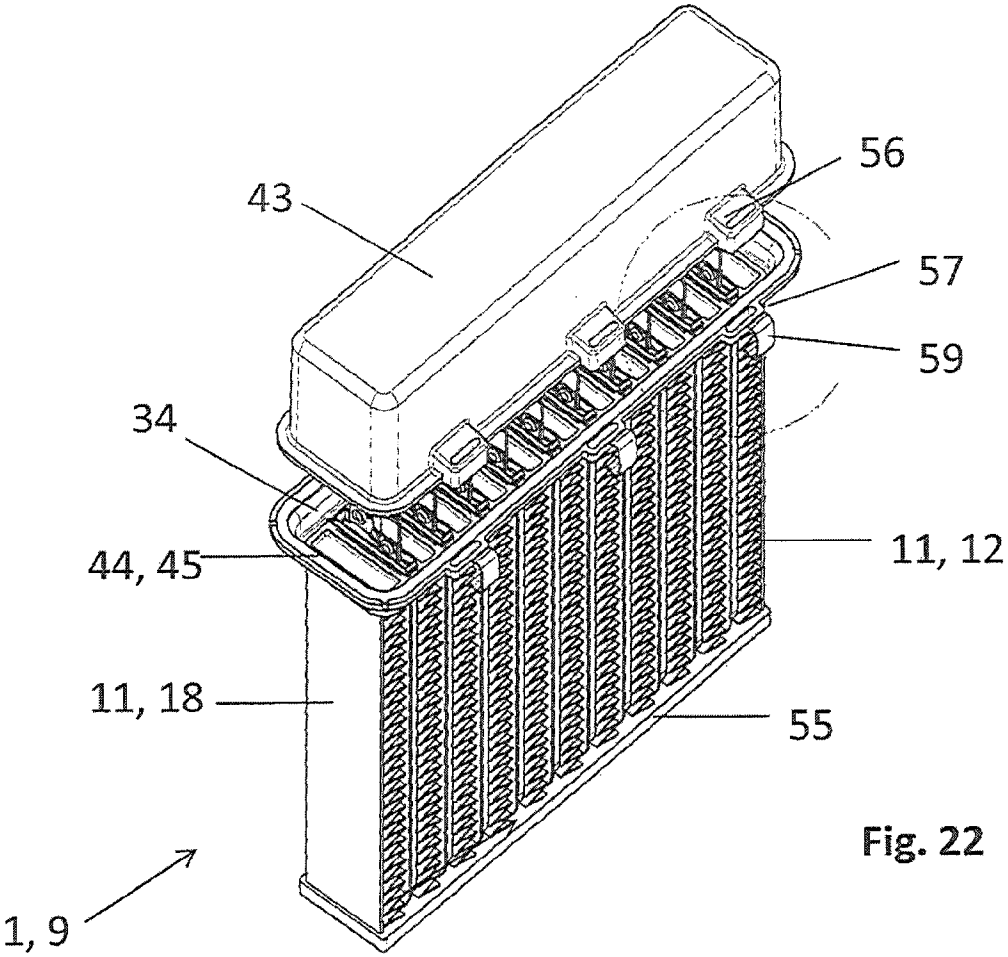
FIG. 22 shows a perspective partial view of the adapter plate in a fourth exemplary embodiment with heating registers and an electronics housing with a clip connection for connecting the adapter plate to the electronics housing.
Figure 23:
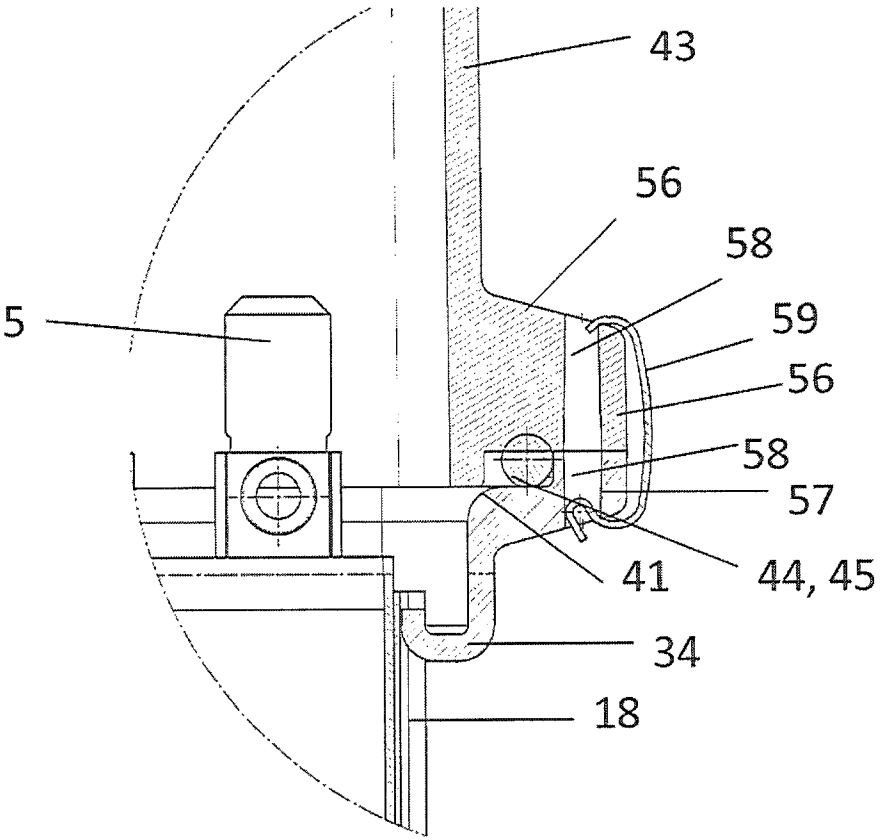
FIG. 23 shows a longitudinal section of the clip connection according to FIG. 22 between the adapter plate and the electronics housing.
Figure 24:
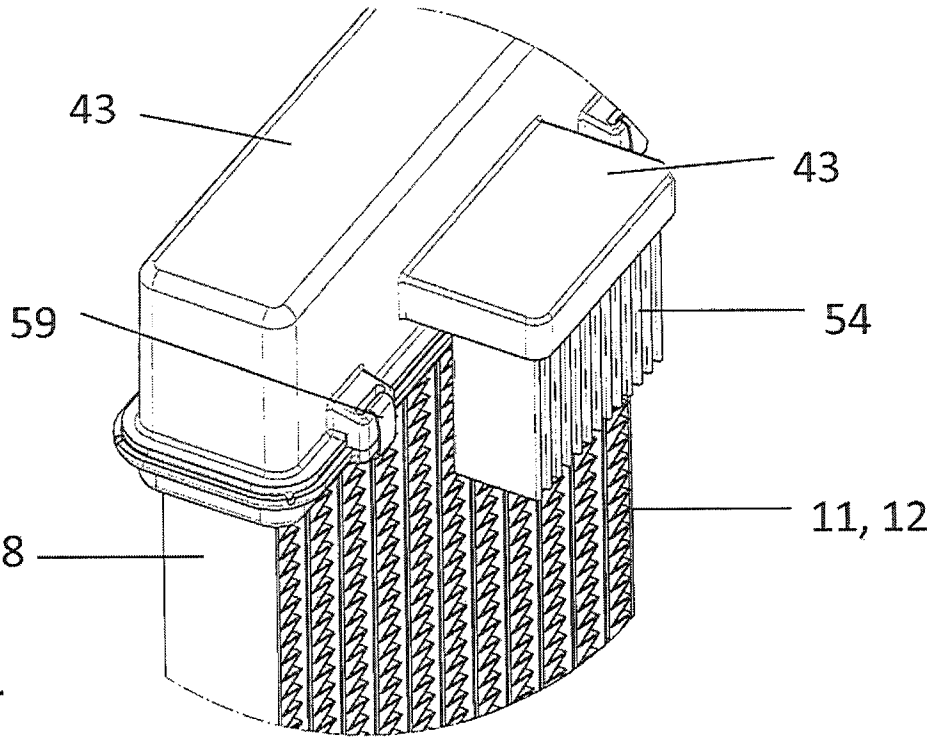
FIG. 24 shows another partial view of the adapter plate according to FIG. 22 with the electronics housing, which is provided with a cooling element.

A fourth exemplary embodiment of adapter plate 34 is shown in FIGS. 22 to 24. In this case, in this exemplary embodiment of heat exchanger 1, adapter plate 34 is connected by a clip connection 52 to electronics housing 43. Adapter plate 34 is provided with a total of six adapter plate latches 57, three adapter plate latches 57 on each side of adapter plate 34. Further, electronics housing 43 at the lower edge also has six electronics housing latches 56, three electronics housing latches 56 on each side. Both electronics housing latches 56 and adapter plate latches 57 have a latch opening 58 (FIG. 23). FIG. 22 shows an unconnected state of electronics housing 43 with adapter plate 34 and FIG. 22 shows a connected state of adapter plate 34 with electronics housing 43. In this case, in the connected state according to FIG. 23, a clip 59 is arranged with its end at the upper end in latch opening 58 of electronics housing latch 56 and at the lower end of latch opening 58 of adapter plate latch 57. Clip 59, for example, made of metal or plastic, is hereby pretensioned and as a result electronics housing latch 56 is pressed onto adapter plate latch 57. In this case, seal 45 between electronics housing 43 and adapter plate 34 has an excess relative to a recessed area in electronics housing 43 or electronics housing latch 56, so that in the mechanical connection state, shown in FIG. 23, seal 45 is pretensioned as an elastic O-ring seal made of rubber between electronics housing 43 and adapter plate 34 and thereby a permanent and reliable fluid-tight seal between electronics housing 43 and adapter plate 34 is assured. O-ring seal 45 is thereby arranged completely circumferential between electronics housing 43 and adapter plate 34.

Figure 25:
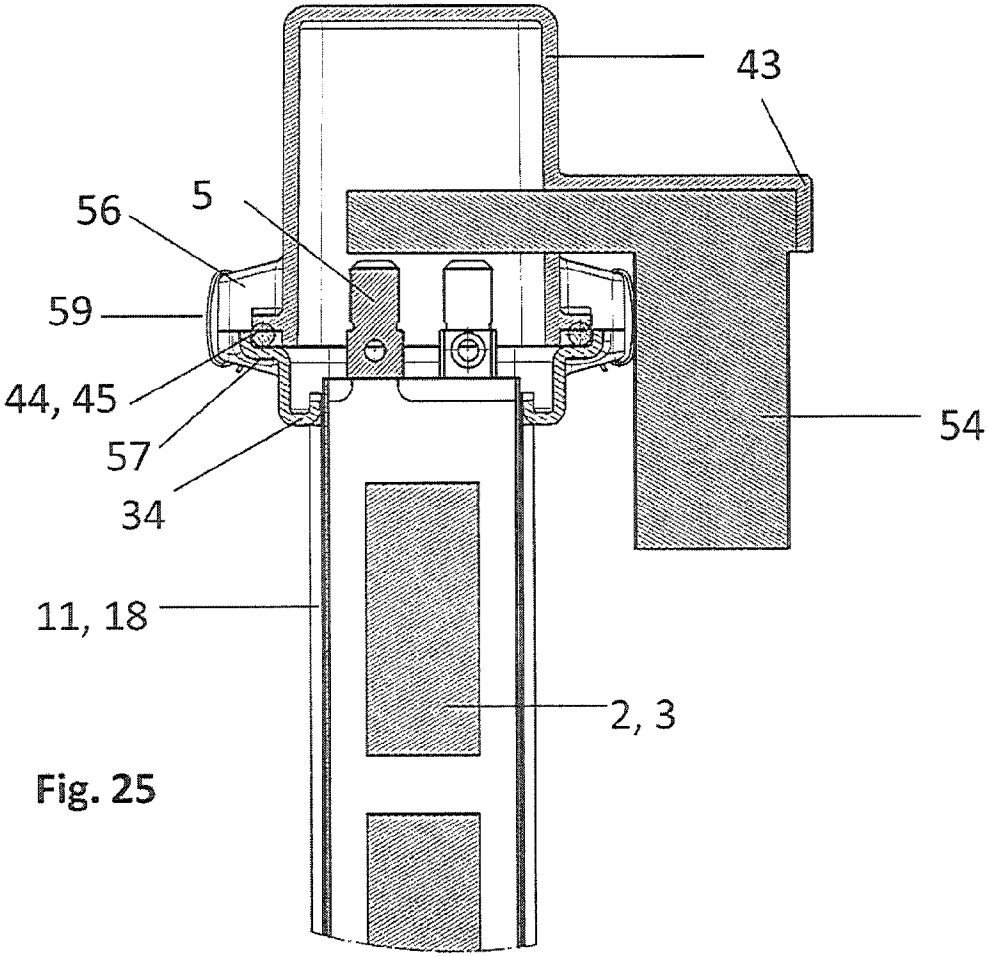
FIG. 25 shows a longitudinal section of the cooling element according to FIG. 24.

In FIGS. 24 and 25, a supplement to the exemplary embodiment is shown in FIGS. 22 and 23. Electronics housing 43 is provided with a cooling element 54 (FIGS. 24 and 25). In this case, cooling element 54 is sealed fluid-tight relative to electronics housing 43 and arranged both within electronics housing 43 and outside electronics housing 43. By means of cooling element 54 arranged outside electronics housing 43, heat can thereby be given off from electronics (not shown), particularly power electronics, by means of heat conduction through cooling element 54 to the ambient air. This is possible without any problems, because ambient air flows around heat exchanger 1.

Figure 26:
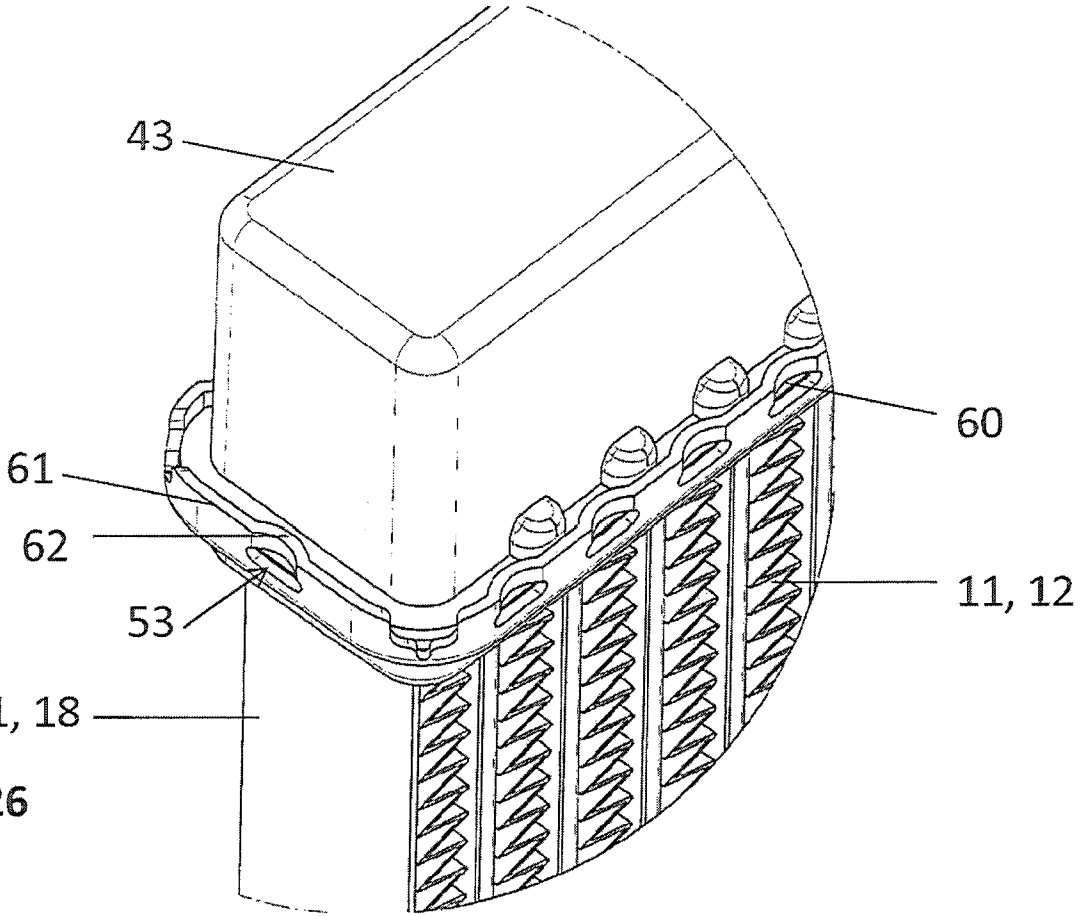
FIG. 26 shows another perspective partial view of the adapter plate in the third exemplary embodiment according to FIG. 15 with heating registers and an electronics housing with a press connection for connecting the adapter plate to the electronics housing.
Figure 27:
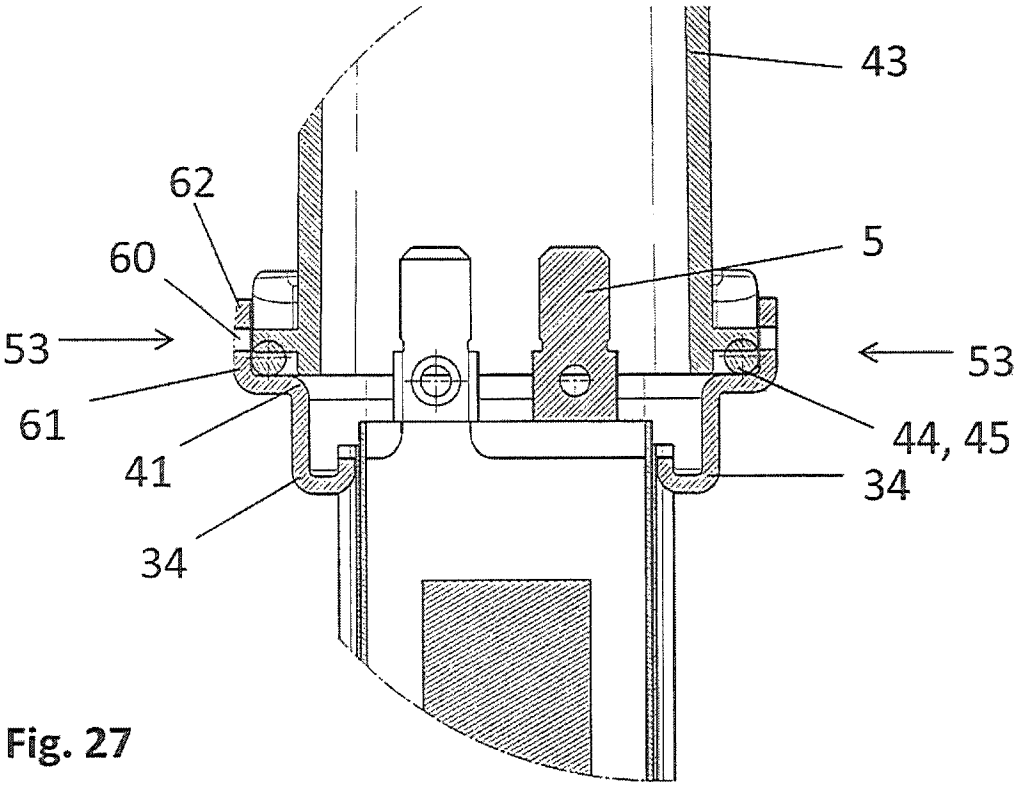
FIG. 27 shows a longitudinal section of the press connection according to FIG. 26.

As a supplement to FIG. 15, adapter plate 34 is shown in the third exemplary embodiment in FIGS. 26 and 27. Here, in the case of adapter plate 34 in the third exemplary embodiment according to FIGS. 15, 26, and 27, adapter plate 34 is connected by means of a press connection 53 to electronics housing 43. Adapter plate 34 has at the outer edge a vertically oriented adapter wall 61. The completely circumferential and vertically oriented adapter wall 61 has only a small dimension in the vertical direction, and a plurality of long holes 60 are arranged in this adapter wall 61. The part of adapter wall 61, which limits long hole 60 or limits it above adapter wall 61, is here a part 62 of adapter wall 61. This part 62 of adapter wall 61 can be deformed here. The fluid-tight sealing between electronics housing 43 and adapter plate 34 occurs in a similar way as in the previous exemplary embodiment by a seal 45 as an elastic O-ring seal, which is elastically pretensioned. To produce a press connection 53, first electronics housing 43 is to be inserted with the bottom opening in the area or space between the vertically oriented adapter wall 61 and to be placed and pressed onto seal 45 until seal 45 is elastically pretensioned. Next, force is to be applied to part 62 of adapter wall 61 above long hole 60 (the non-deformed state of part 62 of adapter wall 61 is shown in FIG. 27), so that as a result part 62 is deformed to the effect that part 62 rests above electronics housing 43 according to the illustration in FIG. 26. As a result, an inseparable mechanical connection between electronics housing 43 and adapter plate 34 can be produced.

Figure 28:
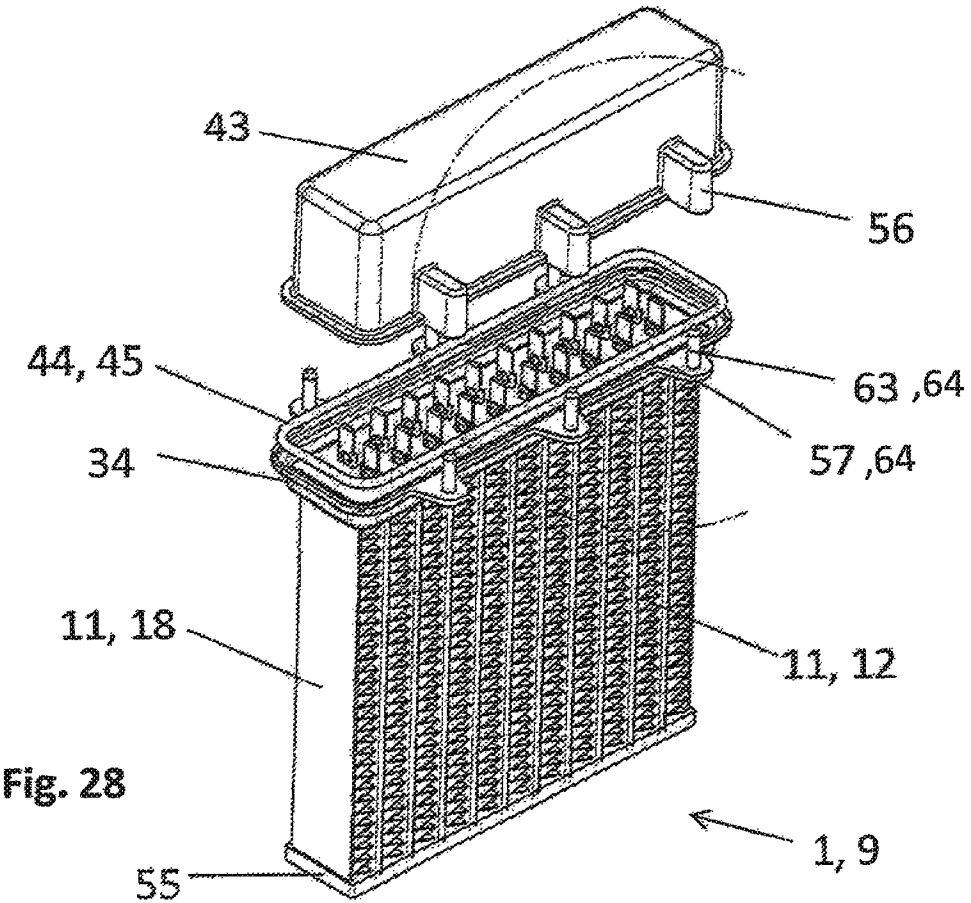
FIG. 28 shows a perspective partial view of the adapter plate in a fifth exemplary embodiment with heating registers and an electronics housing with a screw connection for connecting the adapter plate to the electronics housing.
Figure 29:
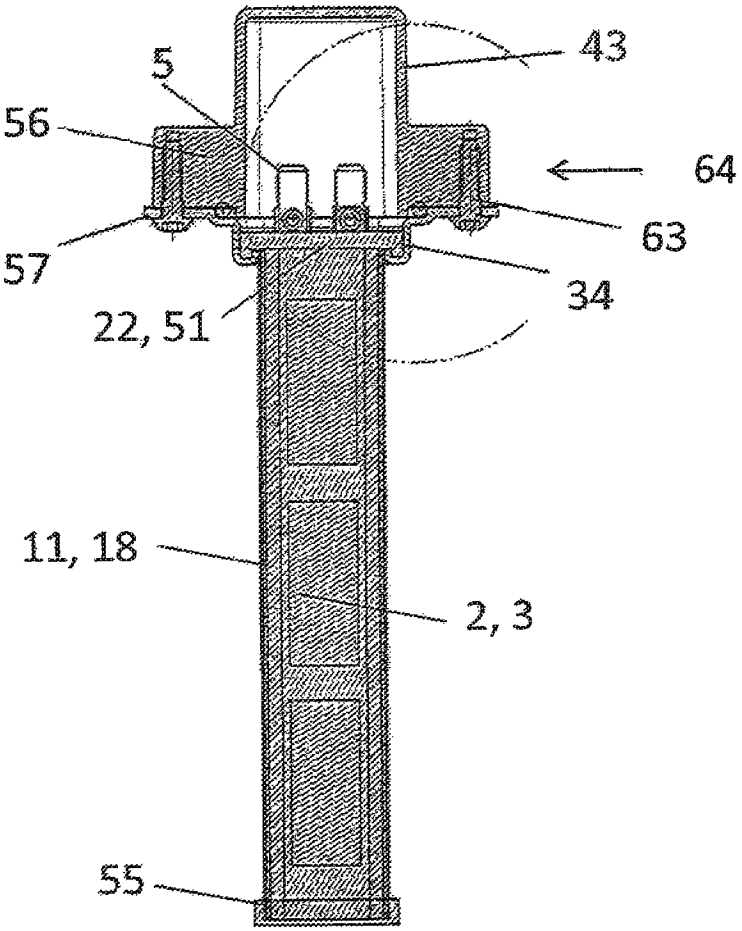
FIG. 29 shows a longitudinal section of the screw connection according to FIG. 28.

A fifth exemplary embodiment of adapter plate 34 is shown in FIGS. 28 and 29. In the fifth exemplary embodiment of adapter plate 34, adapter plate 34 is connected separably by means of a screw connection 64 to electronics housing 43. Adapter plate 34, similar to the fourth exemplary embodiment according to FIGS. 22 to 24, has a total of six adapter plate latches 57, whereby three are arranged on each side. In a similar way, electronics housing 43 has a total of six electronics housing latches 56, three of which are arranged on each side; only three electronics housing latches 56 are visible in FIG. 28 due to the perspective view. Each of the electronics housing latches 56 in this case has a blind hole with a thread. Adapter plate latches 57 have a bored hole, through which a screw 63 can be inserted from below and due to the screw head, which has a larger diameter than the bored hole in adapter plate latch 57, the head of screw 63 lies on adapter plate latch 57. For mechanical connection by means of screw connection 64, electronics housing 43 is to be placed on adapter plate 34 to the effect that the blind holes in electronics housing latches 56 align with the bored holes in adapter plate latches 57 and then by means of a screwdriver, screw 63 with an outside thread can be screwed with the inside thread in the blind holes of electronics housing latches 56. A lower end of tubes 18 of heat exchanger 1 is sealed fluid-tight by means of a cover plate 55 according to the illustration in FIGS. 28 and 29. In this case, cover plate 55 is connected, for example, by means of a solder joint to tubes 18. This also applies to tubes 18 of heat exchanger 1 in the exemplary embodiment shown in FIG. 22.

The details of the different exemplary embodiments can be combined with one another, provided nothing to the contrary is mentioned.

Regarded overall, major advantages are associated with heat exchanger 1 of the invention. The individual heating registers 9 of heat exchanger 1 can be connected to adapter plate 34 mechanically to form a heat exchanger 1 with a plurality of heating registers 9. In so doing, heating registers 9 or tubes 18 of heating registers 9 are arranged fluid-tight at openings 39 of adapter plate 34, so that a fluid-tight sealing of heating registers 9 relative to the surroundings is possible thereby in a simple manner. For example, an electronics housing 43 can be attached fluid-tight to adapter plate 34 and thereby a permanent electrical insulation of heat exchanger 1 is made possible at low technical cost. As a result, permanent protection against contact with the electrically conductive parts of the heat exchanger 1 is possible.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A heat exchanger comprising:

at least one electrical resistance heating element;

at least two conductors electrically connected to the at least one electrical resistance heating element to conduct electric current through the at least one electrical resistance heating element and thereby heat the electrical resistance heating element;

at least two heat-conducting elements that transfer heat from the at least one electrical resistance heating element;

at least one electrical insulating element that insulates electrically the at least two conductors and the at least one electrical resistance heating element;

at least one tube having a tube opening;

at least one cavity bounded by the at least one tube, the at least two conductors, the at least one electrical insulating element, and the at least one electrical resistance heating element are arranged within the at least one cavity; and an adapter plate having at least one opening that corresponds to the tube opening of the at least one tube, wherein the at least one tube is connected fluid-tight to the adapter plate, wherein the adapter plate is connected fluid-tight to at least one of an electronics housing or an HVAC housing, and wherein the at least two heat conducting elements, are attached to opposing outer surfaces of the at least one tube, such that the at least one tube is positioned between the at least two heat conducting elements.

2. The heat exchanger according to claim 1, wherein the tube opening of the at least one tube is inserted within the at least one opening of the adapter plate.

3. The heat exchanger according to claim 1, wherein the at least one opening of the adapter plate has a groove running therearound and the tube opening of the at least one tube is arranged within the groove.

4. The heat exchanger according to claim 1, wherein the tube opening of the at least one tube is inserted within the at least one opening of the adapter plate, such that an outer side of the tube is connected fluid-tight to the adapter plate.

5. The heat exchanger according to claim 1, wherein a shape of an outer side of the at least one tube, at the tube opening, corresponds to a shape of the opening of the adapter plate.

6. The heat exchanger according to claim 3, wherein the tube is connected fluid-tight with the groove on the adapter plate.

7. The heat exchanger according to claim 3, wherein a shape of the tube opening of the at least one tube corresponds to a shape of the groove.

8. The heat exchanger according to claim 1, wherein the adapter plate is formed at least partially of one of metal, aluminum, steel, stainless steel or plastic, wherein the cavity is bounded by the at least one tube only through the opening of the adapter plate and the tube opening with respect to the at least one tube and the adapter plate, wherein a sealing element is arranged between at least one of the adapter plate and the electronics housing or the adapter plate and the HVAC housing, and wherein the sealing element is a seal, an O-ring seal, an adhesive, or silicone.

9. The heat exchanger according to claim 1, wherein the adapter plate is formed as a single piece, and wherein a cooling element that cools electronics within the electronics housing is arranged outside the electronics housing or on the electronics housing.

10. The heat exchanger according to claim 1, wherein the at least one tube is connected to the adapter plate by at least one of bonding, form-fittingly or force-fittingly.

11. The heat exchanger according to claim 1, wherein the at least one tube is connected to the adapter plate with solder, weld, or glued joint and wherein the at least one tube is sealed fluid-tight to the adapter plate with a sealing element or a sealing ring.

12. The heat exchanger according to claim 1, wherein the at least one tube is made up of one or many parts-in cross section, and wherein the at least one tube is symmetric or asymmetric in cross section and wherein the at least one tube is made up of two half-shells.

13. The heat exchanger according to claim 1, wherein the at least one electrical insulating element is at least one of a hardenable or hardened, sealing compound, wherein the at least one electrical insulating element is a molded seal, tubing, a film, a plate, or a ceramic plate, and wherein the plate is connected to the at least one electrical resistance heating element by bonding.

14. The heat exchanger according to claim 1, wherein the adapter plate comprises a first connection section that connects to an electronics housing, wherein the adapter plate comprises a second connection section that connects to an HVAC housing, wherein the adapter plate is connected to at least one of the electronics housing or the HVAC housing by at least one of bonding, form-fittingly or force-fittingly, and wherein the adapter plate is connected to at least one of the electronics housing or the HVAC housing with at least one of a clip connection, a press connection or a screw connection.

15. A vehicle HVAC system, wherein the vehicle HVAC system comprises at least one heat exchanger according to claim 1.

16. The heat exchanger according to claim 1, wherein the at least one electrical resistance heating element is a PTC element.

17. The heat exchanger according to claim 1, wherein the at least two conductors are conductor plates.

18. The heat exchanger according to claim 1, wherein the adapter plate is formed at least partially of one of metal, aluminum, steel, stainless steel or plastic.

19. The heat exchanger according to claim 1, wherein the adapter plate is formed totally of one of metal, aluminum, steel, stainless steel or plastic.

20. The heat exchanger according to claim 1, wherein the adapter plate is formed of thermoplastic.

21. The heat exchanger according to claim 1, wherein the cavity is bounded by the at least one tube only through the opening of the adapter plate and the tube opening with respect to the at least one tube and the adapter plate.

22. The heat exchanger according to claim 1, wherein a sealing element is arranged between at least one of the adapter plate and the electronics housing or the adapter plate and the HVAC housing.

23. The heat exchanger according to claim 1, wherein the at least one tube is connected to the adapter plate with solder, weld, or glued joint.

24. The heat exchanger according to claim 1, wherein the at least one tube is sealed fluid-tight to the adapter plate with a sealing element or a sealing ring.

25. The heat exchanger according to claim 1, wherein the at least one tube is made up of one or many parts in cross section.

26. The heat exchanger according to claim 1, wherein the at least one tube is made up of two parts in cross section.

27. The heat exchanger according to claim 1, wherein the at least one tube is symmetric or asymmetric in cross section.

28. The heat exchanger according to claim 1, wherein the at least one tube is made up of two half-shells.

29. The heat exchanger according to claim 1, wherein the at least one electrical insulating element is at least one of a hardenable or hardened, sealing compound.

30. The heat exchanger according to claim 1, wherein the at least one electrical insulating element is a molded seal, tubing, a film, a plate, or a ceramic plate.

31. The heat exchanger according to claim 1, wherein the at least one electrical insulating element is a plate, and wherein the plate is connected to the at least one electrical resistance heating element by bonding.

32. The heat exchanger according to claim 1, wherein the adapter plate comprises a first connection section that connects to an electronics housing.

33. The heat exchanger according to claim 32, wherein the adapter plate comprises a second connection section that connects to an HVAC housing.

34. The heat exchanger according to claim 33, wherein the adapter plate is connected to at least one of the electronics housing or the HVAC housing by at least one of bonding, form-fittingly or force-fittingly.

35. The heat exchanger according to claim 33, wherein the adapter plate is connected to at least one of the electronics housing or the HVAC housing with at least one of a clip connection, a press connection or a screw connection.

36. The heat exchanger according to claim 1, wherein the heat-conducting element comprises corrugated fins.

37. The heat exchanger according to claim 1, wherein the at least one electrical resistance heating element and the at least two conductors are arranged within the at least one electrical insulating element.

38. The heat exchanger according to claim 1, wherein the at least two heat conducting elements are directly attached to opposing outer surfaces of the at least one tube.

* * * * *